US007637255B1

(12) United States Patent
Freeland

(10) Patent No.: US 7,637,255 B1
(45) Date of Patent: Dec. 29, 2009

(54) TARGET LAUNCHER HAVING VERSATILE MOUNTING CONFIGURATIONS

(76) Inventor: John P. Freeland, P.O. Box 1298, Candler, NC (US) 28715

( * ) Notice: Subject to any disclaimer, the term of this patent is extended or adjusted under 35 U.S.C. 154(b) by 282 days.

(21) Appl. No.: 11/712,793

(22) Filed: Feb. 28, 2007

(51) Int. Cl.
*F41J 9/18* (2006.01)

(52) U.S. Cl. ..... 124/7; 124/8

(58) Field of Classification Search ..... 124/6, 124/7, 8; 248/205.1, 214
See application file for complete search history.

(56) References Cited

U.S. PATENT DOCUMENTS

| | | | | |
|---|---|---|---|---|
| 214,962 | A | 4/1879 | Smith | |
| 722,132 | A | 3/1903 | McQueen | |
| 956,835 | A * | 5/1910 | Taulman | 224/560 |
| 2,080,958 | A | 5/1937 | Beasley et al. | |
| 2,517,463 | A * | 8/1950 | Cobb | 473/481 |
| 2,583,767 | A | 1/1952 | Daignas | |
| 2,700,379 | A | 1/1955 | Brigati | |
| 3,568,199 | A | 3/1971 | Hartness | |
| 3,739,373 | A | 6/1973 | Liming et al. | |
| 3,770,981 | A | 11/1973 | Nelsen | |
| 3,923,033 | A | 12/1975 | Laporte et al. | |
| 4,611,571 | A | 9/1986 | Tressler et al. | |
| 4,699,116 | A | 10/1987 | Freeland et al. | |
| 5,359,576 | A | 10/1994 | Bunner et al. | |
| 5,431,409 | A | 7/1995 | Webster | |
| 5,485,932 | A * | 1/1996 | Romm et al. | 211/87.01 |
| 5,704,341 | A | 1/1998 | Ritzenthaler | |
| 5,871,003 | A | 2/1999 | Laporte et al. | |

OTHER PUBLICATIONS

Photograph of applicant's earlier HITCHIKER® target launcher sold in Apr. 2000. (U.S. Trademark Reg. No. 2,446,621).

* cited by examiner

*Primary Examiner*—John Ricci
(74) *Attorney, Agent, or Firm*—Carter, Schnedler & Warnock, P.A.

(57) ABSTRACT

A target launcher, as well as a target launcher system and set having versatile mounting configurations, for launching practice targets such as archery targets and "clay pigeons" for skeet shooting. A target launcher includes a pair of spaced-apart triangular frame members, each of which has a nominally vertical mounting leg. A target throwing arm pivots between a cocked position and a throwing position. Vehicle mount and ground stand configurations are disclosed. Disclosed configurations employ from one to six target launchers.

18 Claims, 16 Drawing Sheets

TARGET LAUNCHER HAVING VERSATILE MOUNTING CONFIGURATIONS

BACKGROUND OF THE INVENTION

The invention relates generally to target launchers for launching practice targets such as archery targets and "clay pigeons" for skeet shooting.

An example of a prior art target launcher is disclosed in Freeland et al U.S. Pat. No. 4,699,116 titled "Multiple Arm Target Launcher."

SUMMARY OF THE INVENTION

In one aspect, a target launcher is provided, which comprises a pair of spaced-apart triangular frame members. Each of the frame members includes a nominally vertical mounting leg having an upper end and a lower end, as well as a mounting side, a nominally horizontal upper leg joined to the upper end of the vertical mounting leg and extending in a direction away from the mounting side of the vertical mounting leg to a far end of the horizontal upper leg, and a diagonal leg extending between and joined respectively to the far end of the horizontal upper leg and the lower end of the vertical mounting leg, and defining a junction of the diagonal leg with the horizontal upper leg. The target launcher additionally comprises a pivot element supported by the spaced-apart frame members in the general location of the junctions of the diagonal legs with the horizontal upper legs; a target throwing arm supported between the triangular frame members, the target throwing arm having first and second ends, a pivot point intermediate the first and second ends connected to the pivot element, a target holder adjacent the first end, and an elastic device attachment at the second end, the target throwing arm pivoting about the pivot point between a cocked position and a throwing position; an elastic device connected to the an elastic device attachment for urging the target throwing arm from the cocked position to the throwing position; a controllable latch for holding the target throwing arm in the cocked position and for releasing the target throwing arm when a target is to be launched; and a latch-engaging element attached to the target throwing arm near the first end thereof, the latch-engaging element including a substantially horizontal segment supported below the target throwing arm when the target throwing arm is in the cocked position. The controllable latch in turn includes a latch receiver including a pair of spaced-apart side plates each defining a "V" guide opening configured at the bottom to receive the horizontal segment, a pivot element below the bottom of the "V" guide openings, the pivot element defining a pivot axis perpendicular to and extending between the side plates, and a generally "C" shaped pivotable keeper located in between the side plates, the pivotable keeper having a lower pivot point cooperating with the pivot element, an upper segment-engaging surface, and an actuator arm extending perpendicularly to the pivot axis.

In another aspect, a target launcher system is provided, which comprises at least one target launcher including a pair of spaced-apart frame members, each of the frame members in turn including a nominally vertical mounting leg having an upper end and a lower end, as well as a mounting side; at least one right-angled mounting adapter having a mounting adapter insert leg oriented horizontally and receivable in a trailer hitch receiver attached to a vehicle, and a support leg oriented vertically; and at least one mounting plate for securing the vertical mounting legs of the at least one target launcher to the support leg of the right-angled mounting adapter.

In yet another aspect, a target launcher system set capable of a plurality of configurations is provided. The set comprises a plurality of target launchers, each of the target launchers including a pair of spaced-apart frame members, each of the frame members in turn including a nominally vertical mounting leg having an upper end and a lower end, as well as a mounting side; a plurality of right-angled mounting adapters, each of the right-angled mounting adapters having a mounting adapter insert leg oriented horizontally and receivable in a trailer hitch receiver attached to a vehicle, and a support leg oriented vertically; a plurality of mounting plates for securing the vertical mounting legs of the target launchers to the support legs of the right-angled mounting adapters; a receiver expansion bar oriented horizontally and having an expansion bar insert leg extending from the receiver expansion bar at a right-angled and oriented horizontally, the expansion bar insert leg receivable in a trailer hitch receiver attached to a vehicle, and the receiver expansion bar having a pair of end expansion receivers and an intermediate expansion receiver in the form of hollow square sleeves extending from the receiver expansion bar at right angles and oriented horizontally, the expansion receivers having openings facing generally in the opposite direction compared to the expansion bar insert leg; a pair of ground support extensions receivable in respective ones of the pair of end receivers; and a vertical receiver extender having an extender insert leg oriented horizontally and receivable in the intermediate expansion receiver, an extension segment extending upwardly from the extender insert leg to an extension segment upper point, and an extender receiver oriented horizontally and attached to the extension segment upper point. The set is capable of a plurality of configurations. In particular, the set is capable of a vehicle mount configuration with the mounting adapter insert leg of one of the mounting adapters received in the trailer hitch receiver, and at least one of the target launchers secured to the support leg of the one of the mounting adapters via at least one of the mounting plates. The set is capable of an expanded vehicle mount configuration with the expansion bar insert leg received in the trailer hitch receiver, the mounting adapter insert legs of a plurality of the mounting adapters received in corresponding ones of the expansion receivers, and a plurality of target launchers secured to corresponding support legs of the plurality of mounting adapters. The set is capable of a ground stand configuration with the pair of ground support extensions received in respective ones of the pair of end receivers, the extender insert leg received in the intermediate expansion receiver, the mounting adapter insert leg of one of the mounting adapters received in the extender receiver, and at least one of the target launchers secured to the support leg of the one of the mounting adapters via at least one of the mounting plates.

DETAILED DESCRIPTION

Various embodiments of the invention are disclosed herein including a target launcher 20; a target launcher system including at least one target launcher 20 and a number of other components, described in detail hereinbelow, which facilitate a variety of mounting configurations, including vehicle mount and ground stand configurations; and a target launcher system set capable of a plurality of configurations, the set likewise comprising a plurality of components and elements described in detail hereinbelow.

Figure 1:
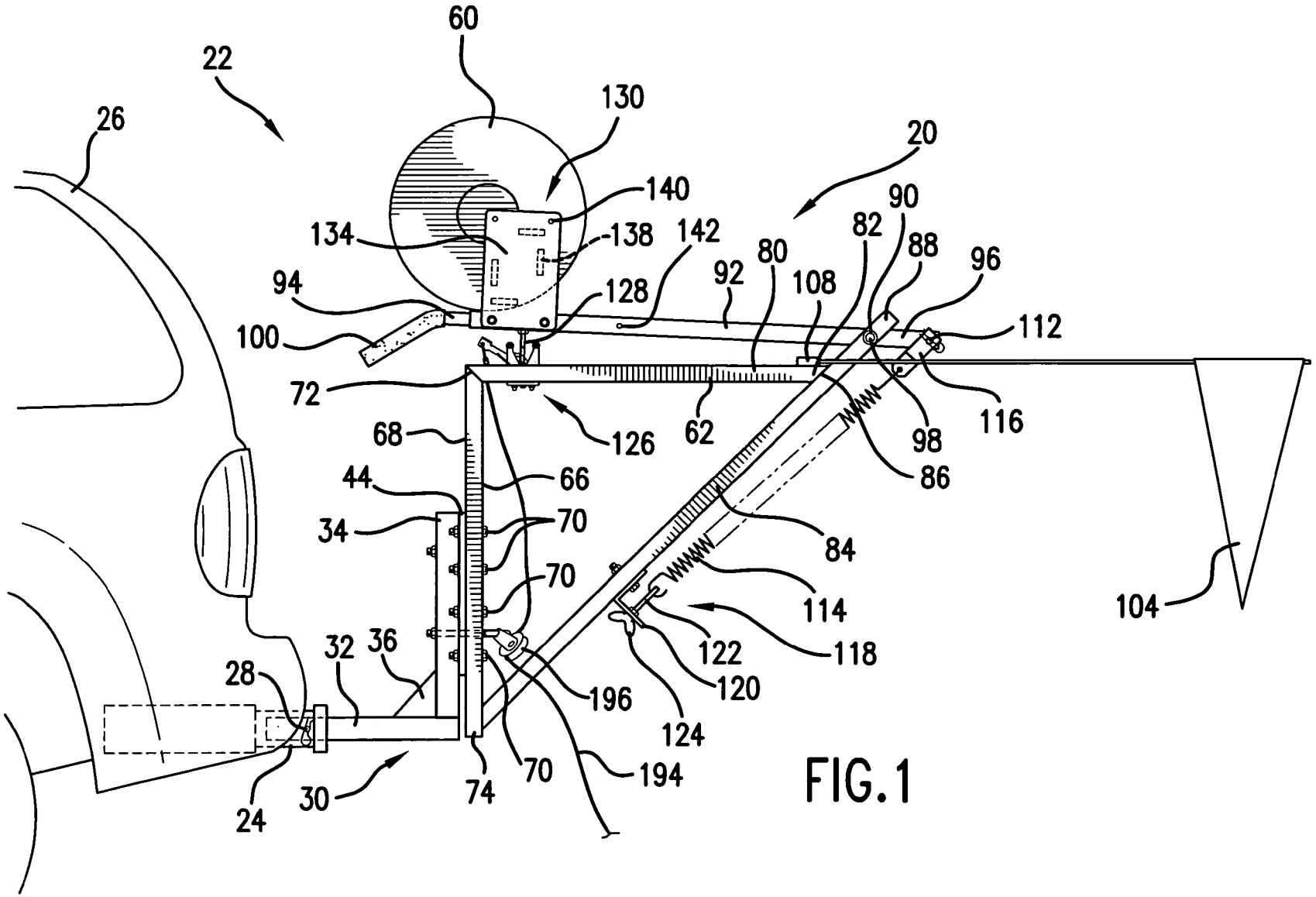
FIG. 1 is a side elevational view of a single target launcher embodying the invention mounted to a trailer hitch receiver attached to the rear of a vehicle, with the throwing arm of the target launcher cocked and an archery target in position to be launched.
Figure 2:
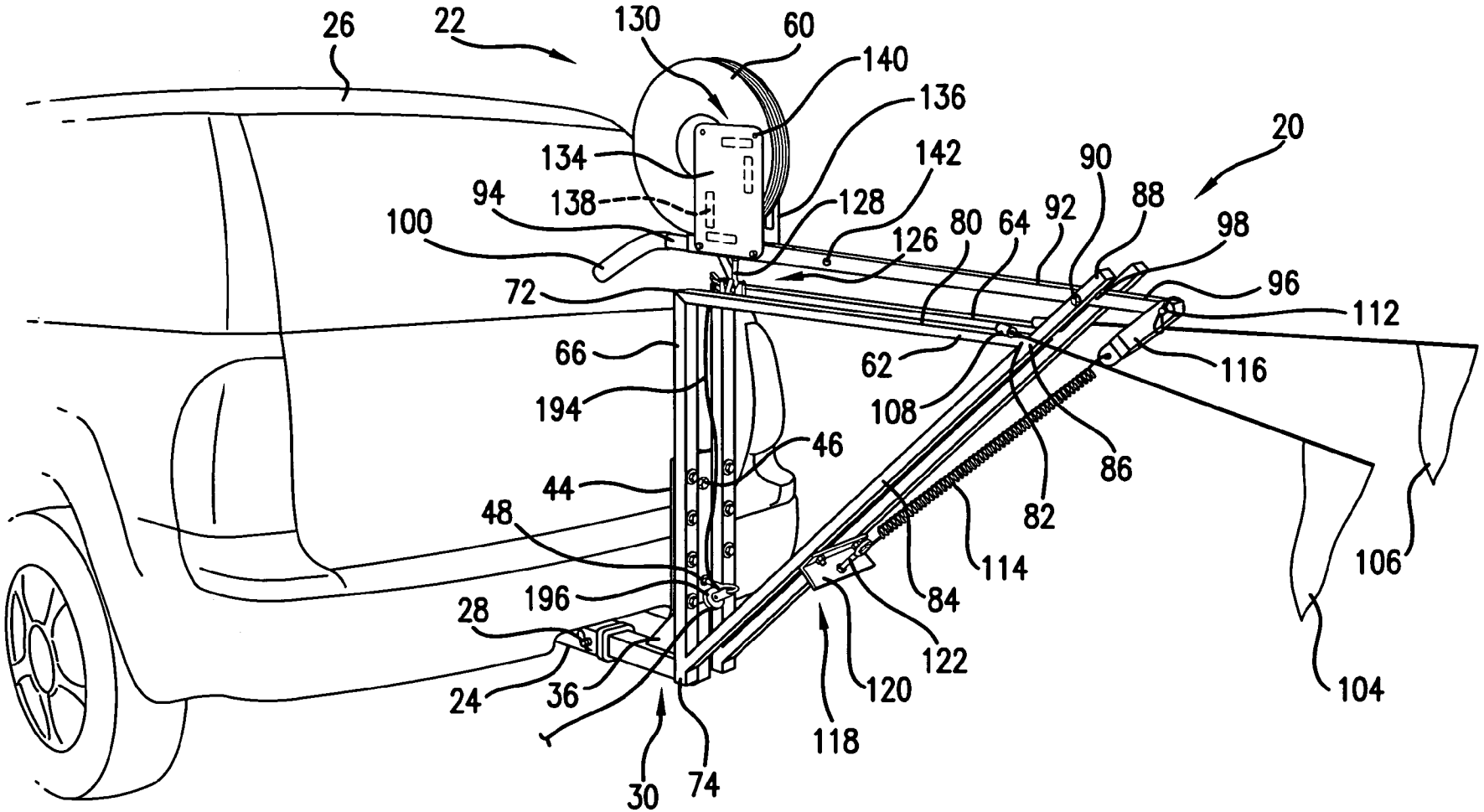
FIG. 2 is a three-dimensional view of the target launcher and vehicle of FIG. 1, generally in a direction towards the left rear corner of the vehicle.
Figure 3:
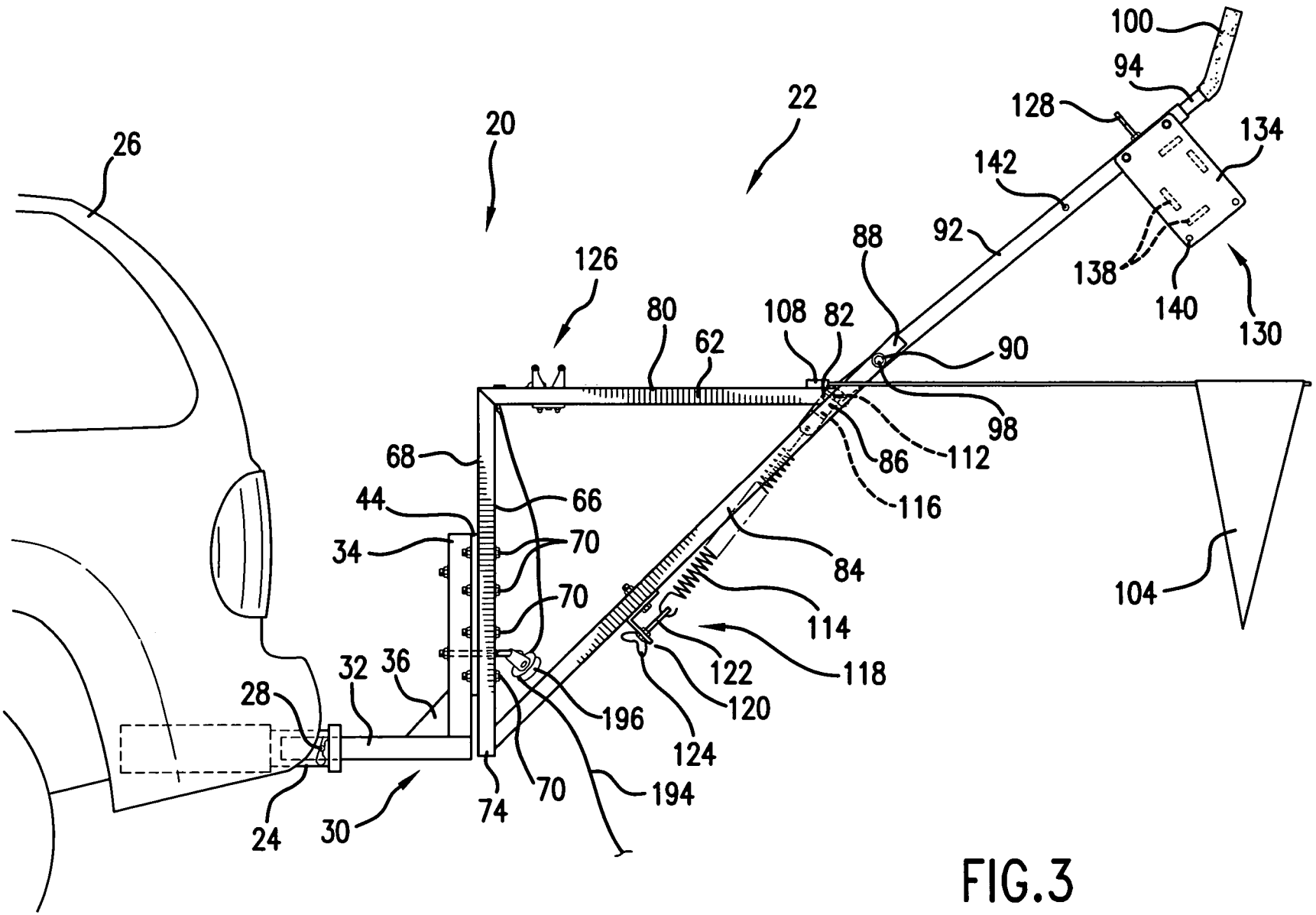
FIG. 3 is a side elevational view of a single target launcher and vehicle of FIG. 1 and in the same orientation as FIG. 1, except that the throwing arm is in the throwing (or thrown) position, the target having been launched.

Referring first to FIGS. 1-3, the target launcher 20 is shown in a vehicle mount configuration 22 mounted to a conventional sleeve-like trailer hitch receiver 24 securely attached to the rear of a vehicle 26. Attachment to the vehicle 26 results in a launching platform which remains stable notwithstanding the forces involved. The trailer hitch receiver 24, as is well known, is intended to receive a drawbar (not shown) which in turn supports a hitch ball (not shown). A conventional pull pin 28 is employed in combination with the trailer hitch receiver 24 to secure whatever element is received in the sleeve-like trailer hitch receiver 24. In the FIG. 1 embodiment, a right-angled mounting adapter 30 is received in the trailer hitch receiver 24, rather than a drawbar (not shown).

Figure 4:
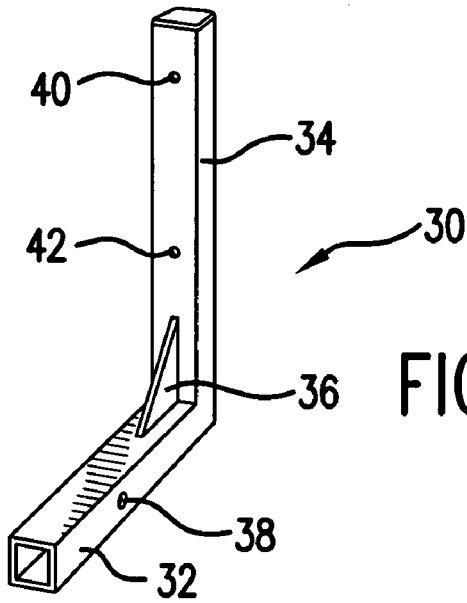
FIG. 4 is a three dimensional view of a right-angled mounting adapter in isolation.

The right-angled mounting adapter 30 is shown in isolation in FIG. 4, and includes an insert leg 32 which in the embodiment of FIGS. 1-3 is oriented horizontally, and is receivable in the trailer hitch receiver 24. A support leg 34 is oriented vertically in the embodiment of FIGS. 1-3. The legs 32 and 34 are made of steel square tubing, welded together, and reinforced by a gusset 36 where joined. An aperture 38 is provided in the insert leg 32 through which the pull pin 28 passes. A pair of mounting apertures 40 and 42 are provided in the vertical support leg 34.

Figure 5:
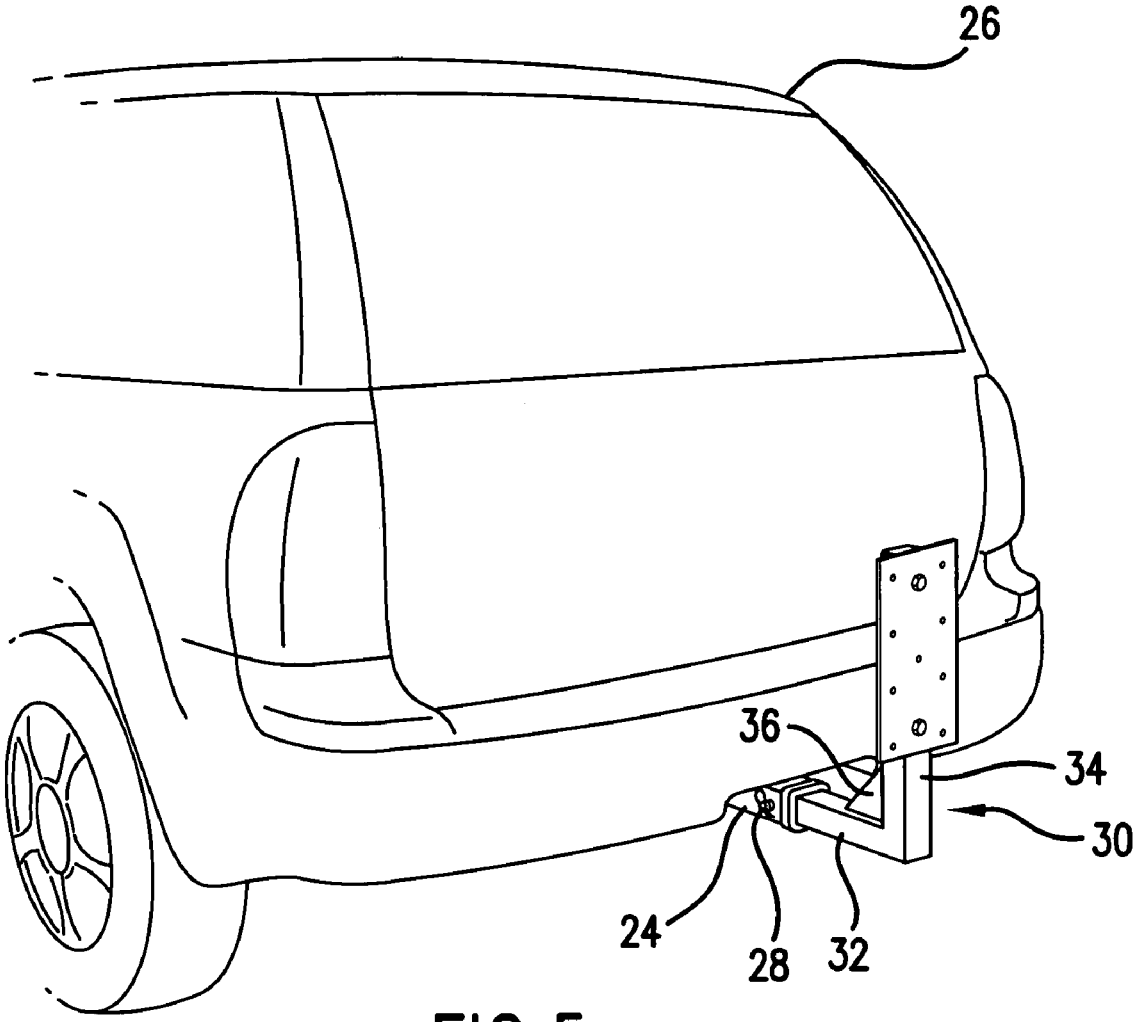
FIG. 5 is a three-dimensional view in the same orientation as FIG. 2 showing a right-angled mounting adapter received in the trailer hitch receiver, and a mounting plate attached to the right-angled mounting adapter and oriented vertically, in preparation for attachment of the target launcher itself.

FIG. 5, which is in the same orientation as FIG. 2, is a three-dimensional view showing the right-angled mounting adapter 30 of FIG. 4 received in the trailer hitch receiver 24. A mounting plate 44 is attached to the right-angled mounting adapter 30 employing a pair of bolts 46 and 48 passing through apertures in the mounting plate 44 and through the mounting apertures 40 and 42 in the mounting adapter support leg 34. The mounting plate 44 is oriented vertically in preparation for attachment of a single target launcher 20, the configuration FIGS. 1-3.

In FIGS. 1-3, the target launcher 20 is oriented for throwing archery targets, such as the archery target 60 which, in an exemplary embodiment, comprises a disk made by laminating circular sheets of corrugated cardboard to each other. For archery target practice, the target 60 is thrown in a manner such that the target rotates about a horizontal axis, either in a trajectory through the air (as a wing target), or bouncing and rolling along the ground (as a ground roller). However, as is described hereinbelow with reference to FIGS. 16-19, the target launcher 20 alternatively may be oriented quite differently for throwing "clay pigeons" for skeet (shotgun) target practice, where the axis of rotation of a target is more nearly vertical. Accordingly, it will be appreciated that, in the description and claims hereinbelow, terms such as "vertical" and "horizontal" are employed in a nominal sense for convenience with reference to a target launcher 20 oriented as shown in FIGS. 1-3. The same target launcher may be mounted in other orientations, in which case an element described as, for example, "vertical" with reference to FIGS. 1-3 may have some other orientation.

Thus, and referring again to FIGS. 1-3, the target launcher 20 more particularly includes a pair of spaced-apart triangular frame members 62 and 64. The triangular frame members 62 and 64 are essentially identical to each other and the elements thereof are described herein with reference to representative triangular frame member 62. The triangular frame members 62 and 64 are formed generally of steel square tubing, and are of welded construction.

The representative frame member 62 includes a vertical mounting leg 66 having a mounting side 68, as well as an upper end 72 and a lower end 74. When the target launcher 20 is assembled in the configuration of FIGS. 1-3, the vertical mounting leg 66 is attached to the mounting plate 44 with the mounting side 68 against the mounting plate 44, and secured by four attachment bolts 70.

The frame member 62 additionally includes a nominally horizontal upper leg 80 joined such as by welding to the upper end 72 of the vertical mounting leg 66, and extending in a direction away from the mounting side 68 of the vertical mounting leg 66 to a far end 82 of the horizontal upper leg 80. A diagonal leg 84 extends between and is joined respectively to the far end 82 of the horizontal upper leg 80 and the lower end 74 of the vertical mounting leg 66. A junction 86 is defined where the diagonal leg 84 is joined to the far end 82 of the horizontal leg 80.

A pivot support extension 88 extends generally upwardly from the junction 86. In the illustrated embodiment, the pivot support extension 88 is simply an integral continuation of the diagonal leg 84.

A pivot element 90 is supported by the spaced-apart triangular frame members 62 and 64 in the general location of the junctions of the diagonal legs with the horizontal upper legs. More particularly, in the illustrated embodiment, the pivot element 90 is on the pivot support extension 88 and comprises a bolt 90.

A target throwing arm 92 is supported between the triangular frame members 62 and 64. The throwing arm 92 has first and second ends 94 and 96, and a pivot point 98 intermediate the first and second ends 96. More particularly, the pivot point 98 is near but spaced from the second end 96. The pivot point 98 cooperates with the pivot element 90 and comprises, for example, a horizontal aperture 98 through the throwing arm 92. The portion of the throwing arm 92 with the horizontal aperture 98 is made of solid one-inch square key stock, and the pivot point/aperture 98 is lined with a bronze bushing (not shown). Spacers (not visible in the drawings) are provided on either side of the throwing arm 92 to center the throwing arm 92 between the two frame members 62 and 64, with the pivot element bolt 90 passing through the spacers. The length of the pivot support extension 88 and the positioning of the pivot element 90 are such that, in the cocked position illustrated in FIGS. 1 and 2, the target throwing arm 92 is located above and generally parallel to the horizontal upper legs 80 of the triangular frame members 62 and 64.

During operation, the target throwing arm 92 pivots about the pivot point 98 between a cocked position as depicted in FIGS. 1 and 2 and a throwing (or thrown) position as depicted in FIG. 3. A cocking handle 100 is provided at the first end 94 of the throwing arm 92 to facilitate cocking the throwing arm 92 by moving it to the cocked position of FIGS. 1 and 2. A pair of safety flags 104 and 106 are received in sockets 108 and 110 attached to the horizontal upper legs 80 of the triangular frame members 62 and 64 to keep an area clear prior to the throwing arm 92 pivoting forcibly to the throwing (or thrown) position of FIG. 3.

For urging the target throwing arm 92 from the cocked position of FIGS. 1 and 2 to the throwing (or thrown) position of FIG. 3, an elastic device attachment 112 is provided at the second end 96 of the throwing arm 92. An elastic device 114, in the form of a coiled steel spring 114, also termed a main spring 114, is connected to the elastic device attachment 112. More particularly, a main spring link 116 is pivotally connected to the elastic device attachment 112, and a lower spring attachment and adjustment assembly 118 is attached to the diagonal legs 84 near the lower ends of the diagonal legs 84. The main spring 114 is in tension, and extends between the main spring link 116 and the lower spring attachment and adjustment assembly 118. The lower spring attachment and adjustment assembly 118 includes a main spring tension bracket 120 bolted to the diagonal legs 84 of the two triangular frame members 62 and 64, and a main spring eyebolt 122 having a threaded end which passes through an aperture in the main spring tension bracket 120. For adjustment of spring tension, a threaded tension adjustment knob 124 engages a main spring eyebolt on the lower side of the main spring tension bracket 120.

Figure 6:
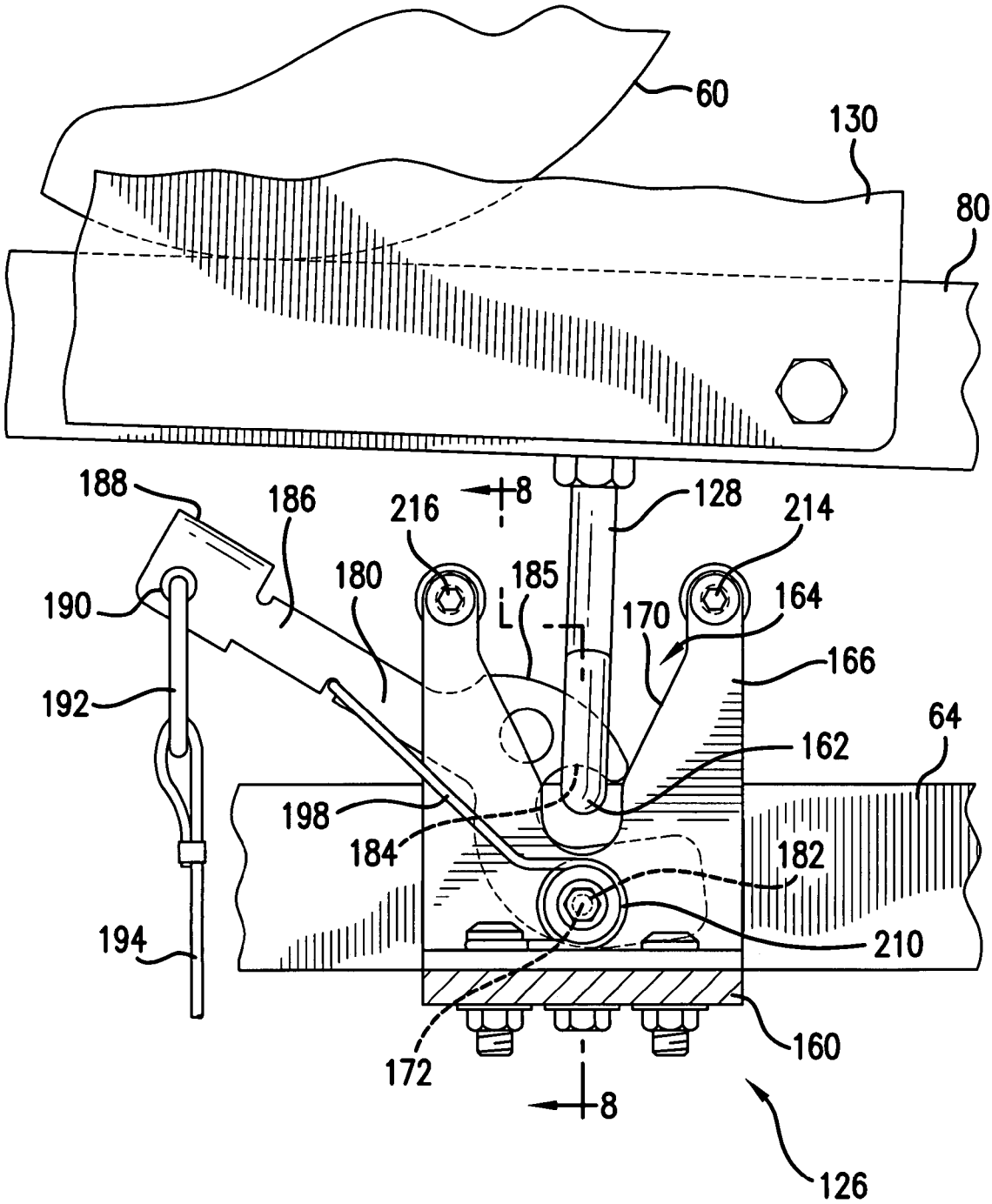
FIG. 6 is an enlarged side elevational view showing the latch portion of the FIG. 1 target launcher, with the throwing arm of the target launcher cocked.
Figure 7:
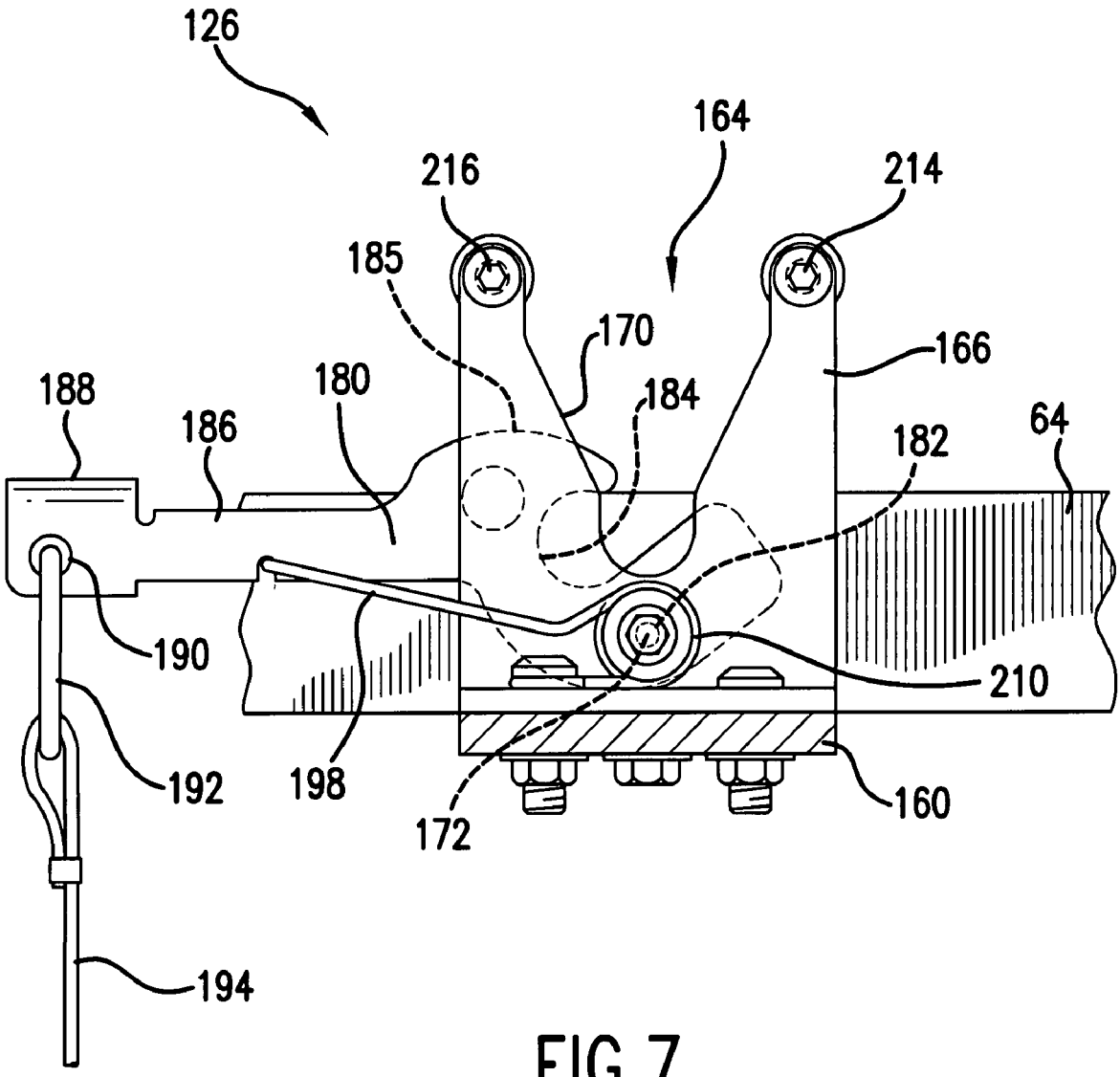
FIG. 7 is an enlarged side elevational view like that of FIG. 6, but with the throwing arm released from the latch, corresponding to the throwing (or thrown) position of FIG. 3.
Figure 8:
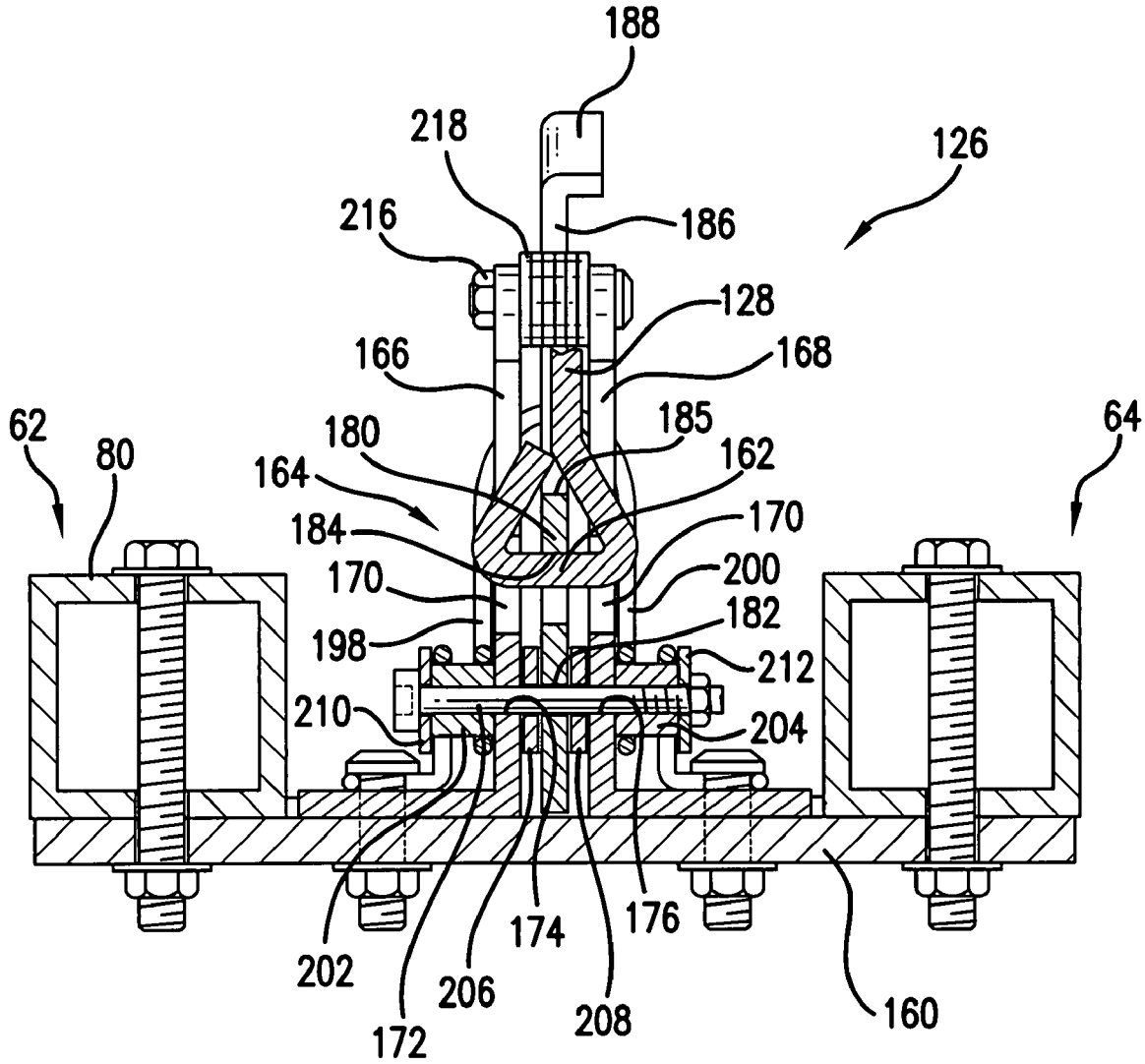
FIG. 8 is a cross-sectional view taken on line 8-8 of FIG. 6.

A controllable latch, generally designated 126 and described hereinbelow with reference to FIGS. 6-8, is provided for holding the target throwing arm 92 in the cocked position of FIGS. 1 and 2, and releasing the target throwing arm 92 when a target is to be launched, allowing force of the main spring 114 to pivot the throwing arm 92 to the throwing (or thrown) position of FIG. 3. A latch engaging element 128 is attached to the underside of the target throwing arm 92 towards the first end 94 with the cocking handle 100. In the illustrated embodiment the latch engaging element 128 comprises an eyebolt with a triangular head.

A target holder 130 is attached to the target throwing arm 92 near the first end 94 for holding the target 60 prior to launch. The target holder 130 more particularly comprises a pair of metal plates 134 and 136 bolted to opposite sides of the target throwing arm 92 and extending upwardly, defining a space for the target 60 in between and on top of the throwing arm 94. To facilitate a desirable degree of frictional engagement with the target 60, strips 138 of "hook" material intended as part of a hook-and-loop fastener are adhesively attached to facing inside surfaces of the metal plates 134 and 136. Alternatively, circular pieces of indoor/outdoor carpet (not shown) may be employed. Those strips of "hook" material 138 or carpet provide sufficient frictional engagement to hold the target 60 in place prior to launch and, yet allow release of the target 60 when the throwing arm 92 pivots driven by the force of the main spring 114. Target trajectory is controlled by positioning of the target 60 along the throwing arm 92. Archery targets placed back towards the cocking handle 100 as illustrated in FIGS. 1 and 2 have a relatively more vertical trajectory (but, nevertheless, are thrown out away from the target launcher 20 with a trajectory that has a horizontal component) when launched as wing targets. Archery targets placed forward near the pivot point 98 have a flatter trajectory when launched, including ground rollers. To facilitate a range of target positions, additional attachment apertures 140 and 142 are provided on the middle plates 134, 136 and throwing arm 92, respectively, so that the target holder 130 can optionally be positioned closer to the pivot point 98.

With reference now to FIGS. 6-8, the controllable latch 126 is bolted to a latch base plate 160 secured to the undersides of the horizontal upper legs 80 of the triangular frame members 62 and 64. The latch engaging element 128 includes a horizontal segment 162 supported below the target throwing arm 92 when the target throwing arm 92 is in the cocked position of FIGS. 1, 2, 6 and 8. Although the latch engaging element 128 preferably comprises a triangular eyebolt with a well-defined horizontal segment 162, it will be appreciated a round eyebolt may as well be employed, in which case the substantially horizontal segment 162 takes the form of a small arc of a circle.

The controllable latch 126 itself includes a latch receiver 164, in turn including a pair of spaced-apart side plates 166 and 168 each defining a "V", guide opening 170 configured at the bottom to receive the horizontal segment 162. The side plates 166 and 168 are bolted to the latch base plate 160.

Located below the bottom of the "V" guide opening 170 is a pivot element 172 defining a pivot axis perpendicular to and extending between the side plates 166 and 168. In the illustrated embodiment, the pivot element 172 comprises a bolt 172 apertures 174 and 176 in the side plates 166 and 168.

A generally "C" shaped pivotable keeper 180 is located between the side plates 166 and 168. The pivotable keeper 180 has a relatively lower pivot point 182 in the form of an aperture through which the pivot element 172 passes, an upper segment-engaging surface 184 for engaging the horizontal segment 162 of the latch engaging element 128, a top curved cam surface 185, and an actuator arm 186 extending perpendicularly to the pivot axis 172. The distal end of the actuator arm 186 is bent over to form a thumb rest 188, and an aperture 190 below the thumb rest 188 receives a quick link coupler 192 for attachment of a launch trigger cable 194. The launch trigger cable 194 is guided by a pulley 196 attached by means of an eye bolt to the mounting plate 44, in between the vertical mounting legs 66 of the target launcher 20 (FIGS. 1-3). A pair of springs 198 and 200 urge the pivotable keeper 180 from the unlatched position of FIG. 7 to the latched position of FIGS. 6 and 8.

The controllable latch 126 additionally includes a pair of bushings 202 and 204 on the outsides of the side plates 166 and 168 through which the pivot bolt 172 passes for supporting the springs 198 and 200, a pair of brass washers 206 and 208 on either side of the pivotable keeper 180 on the inside surfaces of the side plates 166 and 168, and a pair of steel washers 210 and 212 to aid in retaining the springs 198 and 200. At their upper ends, the side plates 166 and 168 are secured to each other by bolts 214 and 216 which secure the side plates 166 and 168 to each other in a spaced-apart manner, aided by a stack of spacer washers 218.

During operation, the throwing arm 92 is cocked by grasping the cocking handle 100 and pivoting the throwing arm 92 until the horizontal segment 128 of the triangular eyebolt 128 engages the controllable latch 126 to achieve the latched configuration of FIGS. 6 and 8. More particularly, the throwing arm 92 is pulled down with a slight "slamming" motion which causes the eyebolt 128 to engage the top curved cam surface 185 of the pivotable keeper 180 to momentarily pivot the keeper 180 towards the released position of FIG. 7 which allows the horizontal segment 128 of the eyebolt 128 to drop into the "V" guide opening 170. The keeper 180 then returns to the cocked position of FIGS. 6 and 8 under the urging of the springs 198 and 200, and the horizontal segment 128 of the triangular eyebolt 128 engages the segment-engaging surface 184. The throwing arm 92 is subsequently released by pulling down on the launch trigger cable 194, which pulls the actuator arm 186 down to pivot the keeper 180 sufficiently to release the eyebolt 128 from the segment-engaging surface 184.

One or more target launchers 20 may be employed in a variety of configurations as described next hereinbelow, the description concluding with a "Vehicle Mount Configuration Table" and a "Ground Stand Configuration Table" summarizing possible mounting configurations and components used in the various mounting configurations. Thus, in one aspect the invention is embodied in a target launcher system, and in another aspect the invention is embodied in a target launcher system set capable of a plurality of configurations.

Figure 9:
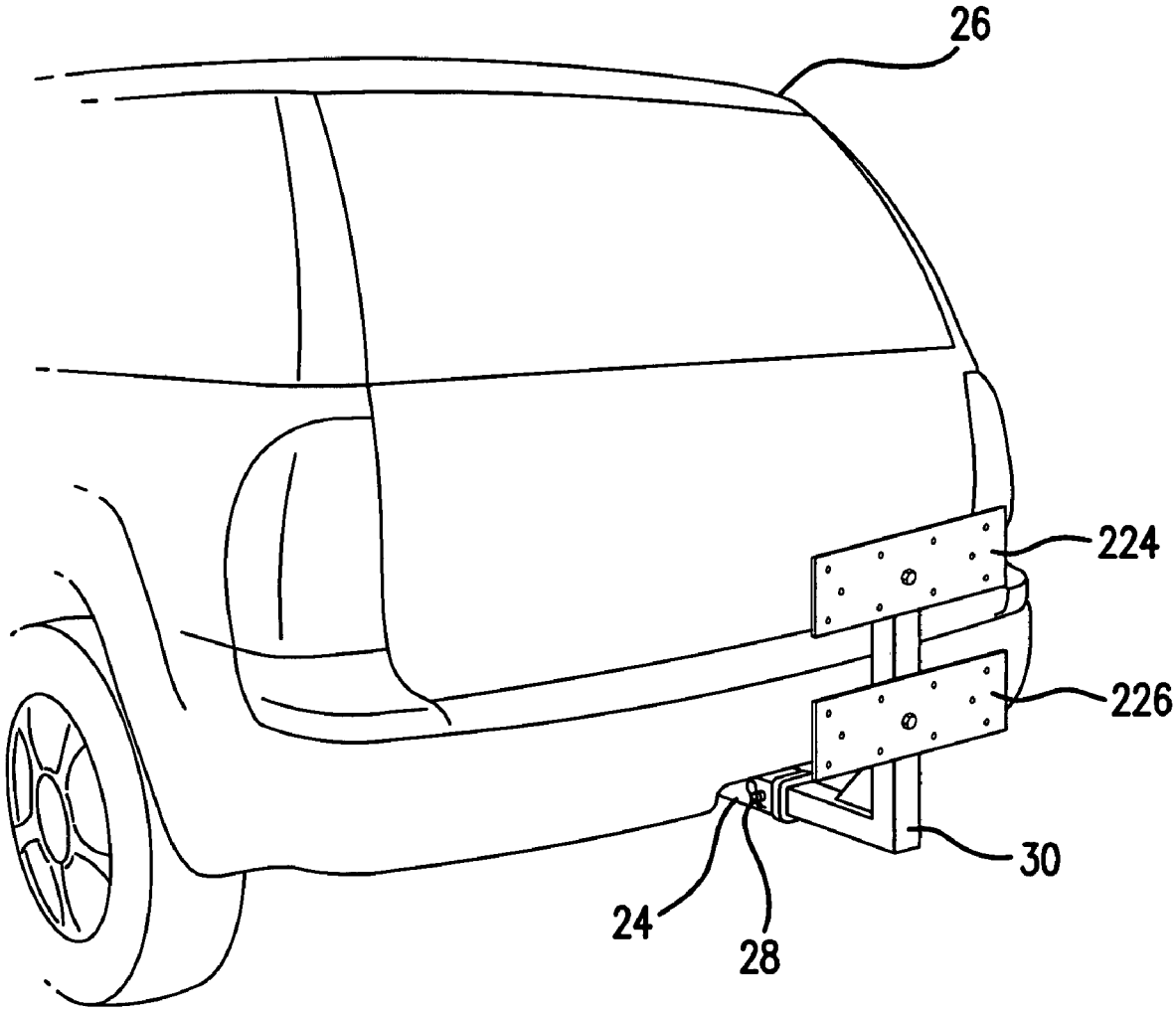
FIG. 9 is a three-dimensional view like that of FIG. 5 showing a right-angled mounting adapter received in the trailer hitch receiver, but with two mounting plates attached to the right-angled mounting adapter and oriented horizontally, in preparation for the attachment of a pair of target launchers.
Figure 10:
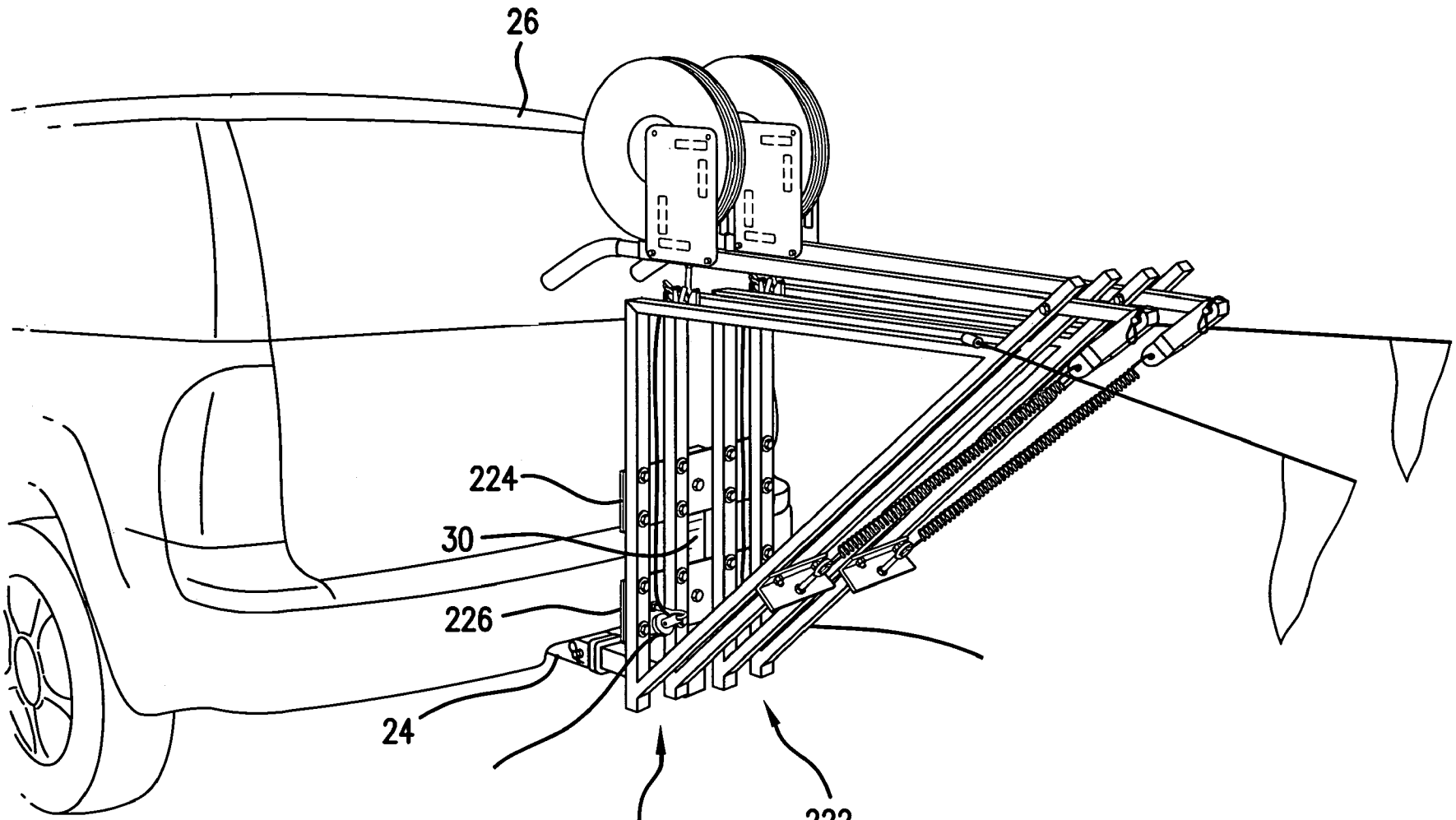
FIG. 10 is a three dimensional view like that of FIG. 2, but with a pair of target launchers attached to the two mounting plates shown in FIG. 9.

With reference to FIGS. 9 and 10, a pair of target launchers 220 and 222 are attached to the vehicle 26, in place of the single target launcher 20 of FIG. 2. In the double launcher configuration of FIG. 10, the trailer hitch receiver 24 and the right-angled mounting adapter 30 are employed as before. However, rather than the single mounting plate 44 oriented vertically, in FIGS. 9 and 10 a pair of mounting plates 224 and 226 are secured to the mounting adapter support leg 34 of the right-angled mounting adapter 30, and are oriented horizontally. Apertures in the mounting plates 224 and 226 enable mounting of the two target launchers 220 and 222 side-by-side as illustrated in FIG. 10. The target launchers 220 and 222 are mounted by their nominally vertical mounting legs 66 to the mounting plates 224 and 226.

In the illustrated embodiments, up to six target launchers, organized as three pairs, can be attached to the trailer hitch receiver 24 and thus to the rear of the vehicle 26.

Figure 11:
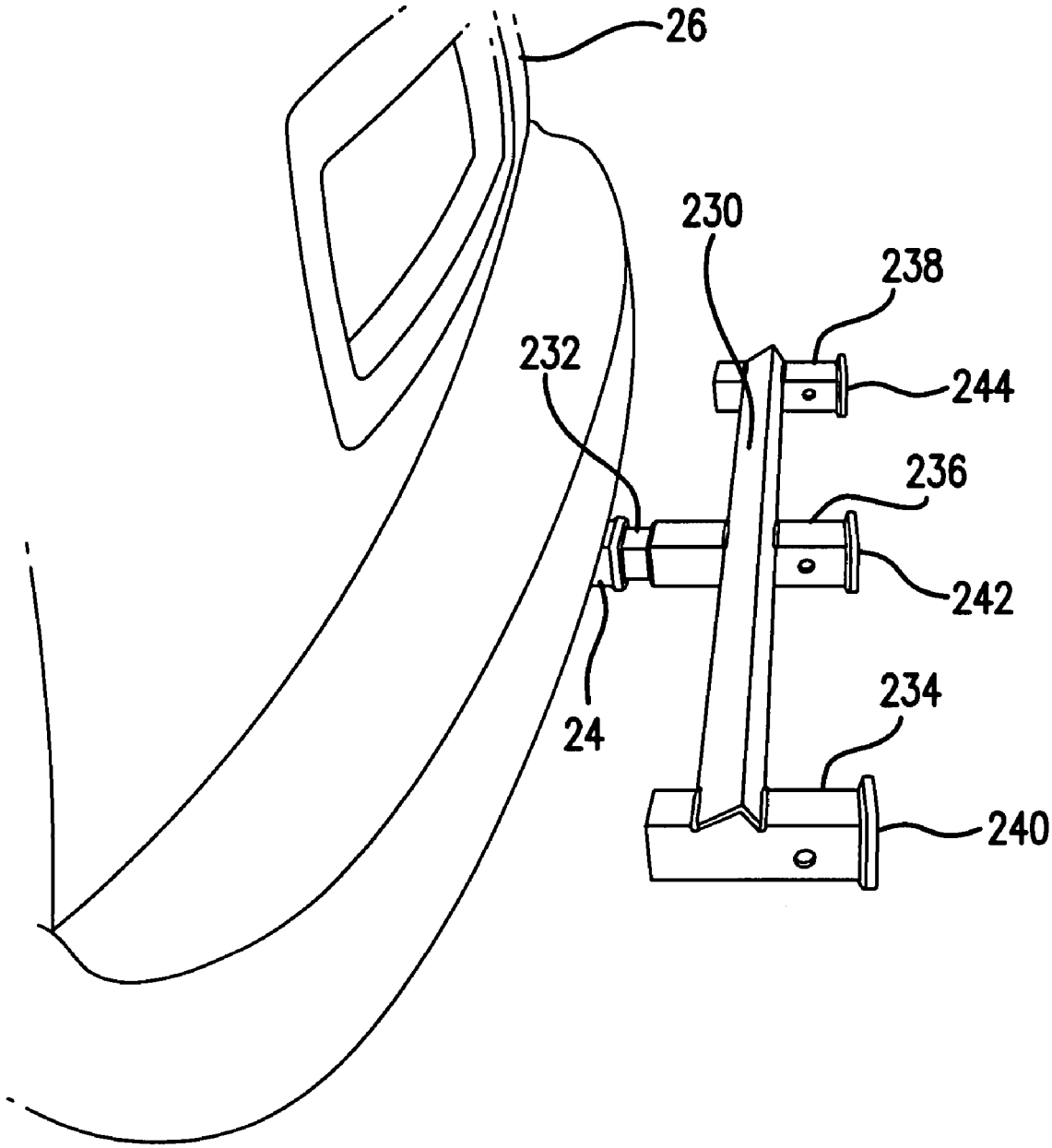
FIG. 11 is a three-dimensional view showing a receiver expansion bar by itself received in the trailer hitch receiver.

Thus, with reference to FIG. 11, a receiver expansion bar 230 is provided. It should be noted that the same element which is termed a receiver expansion bar 230 in the context of FIG. 11 in the vehicle mount configuration may also be employed for different purpose in a ground stand configuration, described hereinbelow with particular reference to FIGS. 13-15.

Figure 13:
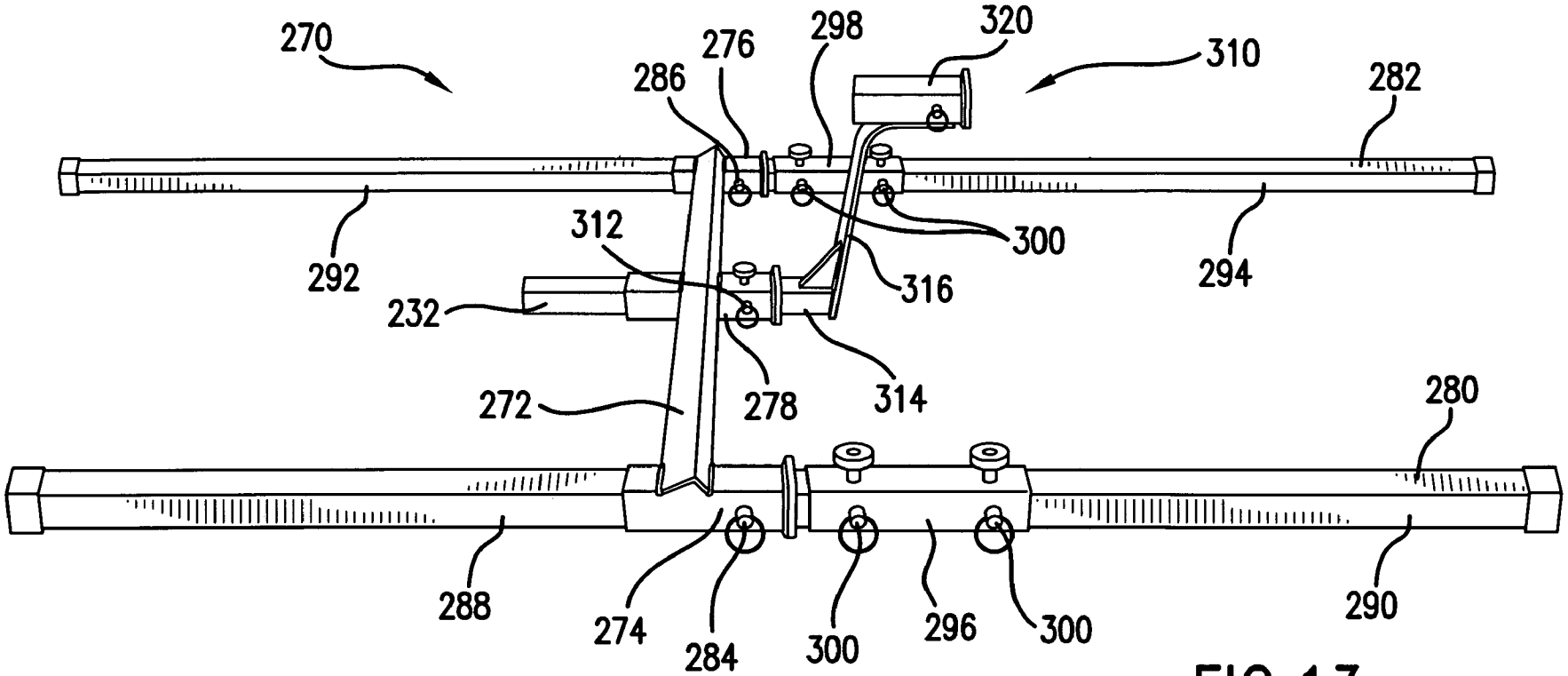
FIG. 13 is a three-dimensional view of a ground stand embodying the invention, employing the receiver expansion bar also shown in FIG. 11 but as part of the ground stand, with a vertical receiver extender and ground support extensions in place.

In FIG. 11, the receiver expansion bar 230 is oriented horizontally and has an expansion bar insert leg 232. The expansion bar insert leg 232 is best seen in FIG. 13 although, in the FIG. 13 ground stand configuration, the expansion bar insert leg 232 is not actually functional; it is a vestige of the use in the vehicle mount configuration. The expansion bar insert leg 232 extends from the receiver expansion bar 230 at a right angle and is oriented horizontally, and is receivable in the trailer hitch receiver 24 attached to the vehicle 26.

The receiver expansion bar 230 has a plurality of expansion receivers 234, 236 and 238 oriented horizontally. The expansion receivers 234, 236 and 238 have openings 240, 242 and 244 facing generally in the opposite direction compared to the expansion bar insert leg 234, and serve as expansions of the trailer hitch receiver 24. Thus, each of the expansion receivers 234, 236 and 238 is capable of receiving the insert leg 32 of a right-angled mounting adapter 30.

Figure 12:
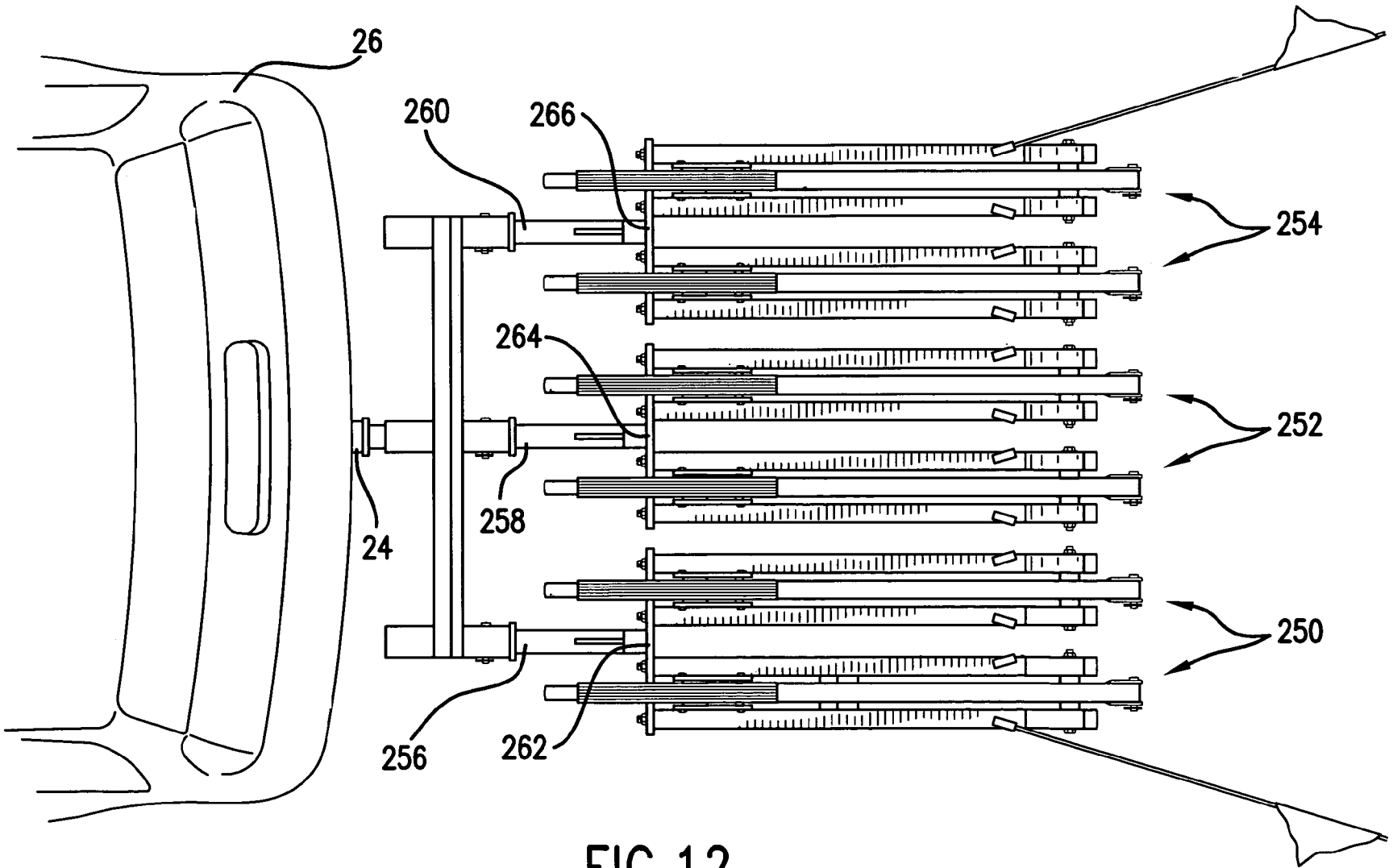
FIG. 12 is a top plan view showing six target launchers (organized as three pairs) mounted to a trailer hitch receiver attached to the rear of a vehicle, employing the receiver expansion bar of FIG. 11, three right-angled mounting adapters, and six mounting plates (organized as three pairs) oriented horizontally.

FIG. 12 is a top plan view illustrating the configuration where six target launchers (organized as three pairs 250, 252, 254) are attached to the receiver expansion bar 230 and thus to the trailer hitch receiver 24. Each pair 250, 252 and 254 of launchers corresponds to the pair of launchers 220 and 222 in FIG. 10, and each pair 250, 252 and 254 is secured to a respective right-angled mounting adapter 256, 258 and 260 by a pair of horizontally-oriented mounting plates 262, 264 and 266, like the pair of mounting plates 224 and 226 shown in FIG. 10.

As mentioned hereinabove, embodiments of the invention can also be assembled in a portable ground stand configuration, without the use of a vehicle. FIG. 13 shows a ground stand 270 including a horizontal bar 272 having a pair of end receivers 274 and 276, as well as an intermediate receiver 278, attached to and extending from the horizontal bar 272 at right angles. It will be appreciated that the horizontal bar 272 of FIG. 13 is the same element which is termed a receiver expansion bar 230 in FIG. 11, but used for a different purpose. Thus, the end receivers 274 and 276 in FIG. 13 are the expansion receivers 234 and 238 in FIG. 11, and the intermediate receiver 278 in FIG. 13 is the expansion receiver 236 in FIG. 11.

In FIG. 13, a pair of ground support extensions 280 and 282 are received in the end receivers 274 and 276 by passing through the hollow square sleeves, and are secured in position by a pair of pull pins 284 and 286. Each of the ground support extensions 280 and 282 in turn includes a pair of segments 288, 290 and 292, 294 attached to each other by connection sleeves 296 and 298, and secured in position by pull pins 300. The expansion bar insert leg 232 serves no function in the FIG. 13 configuration.

In order to raise a target launcher a short distance above the ground for convenient more access and usage, a vertical receiver extender 310 is received in the intermediate receiver 278, and secured by a pull pin 312. The vertical receiver extender 310 is shown in isolation in FIG. 14, and includes an extender insert leg 314 oriented horizontally and received in the intermediate receiver 278, an extension segment 316 extending upwardly from the extender insert leg 314 to an extension segment upper point 318, and a sleeve-like extender receiver 320 oriented horizontally and attached to the extension segment upper point 318.

Figure 14:
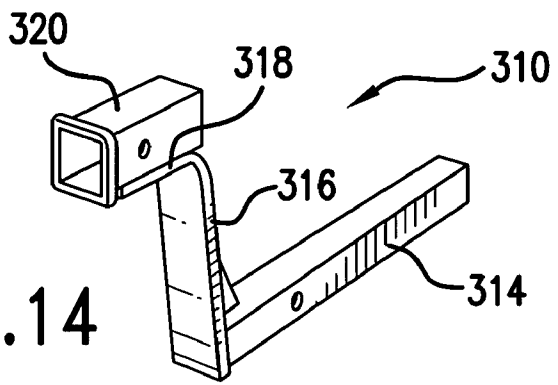
FIG. 14 is a three dimensional view of the vertical receiver extender in isolation.

The extender receiver 320 of FIGS. 13 and 14 thus serves the same general function as the trailer hitch receiver 24 in the vehicle-mount configurations of FIGS. 1-3, 10 and 12. The ground support extensions 280 and 282 provide sufficient stability to maintain target launchers in position despite the forces imparted during launching.

Typically, one or two target launchers are attached to the ground stand 270 basically in the same manner as the vehicle mount configurations described hereinabove with reference to FIGS. 1-3 and 10, except that, instead of the trailer hitch receiver 24, the extender receiver 320 is employed to receive a right-angled mounting adapter, such as the right-angled mounting adapter 30 shown in FIG. 4. One or two mounting plates are employed, such as the single mounting plate 44 of FIG. 2, or the pair of mounting plates 224 and 226 shown in FIG. 10.

Figure 15:
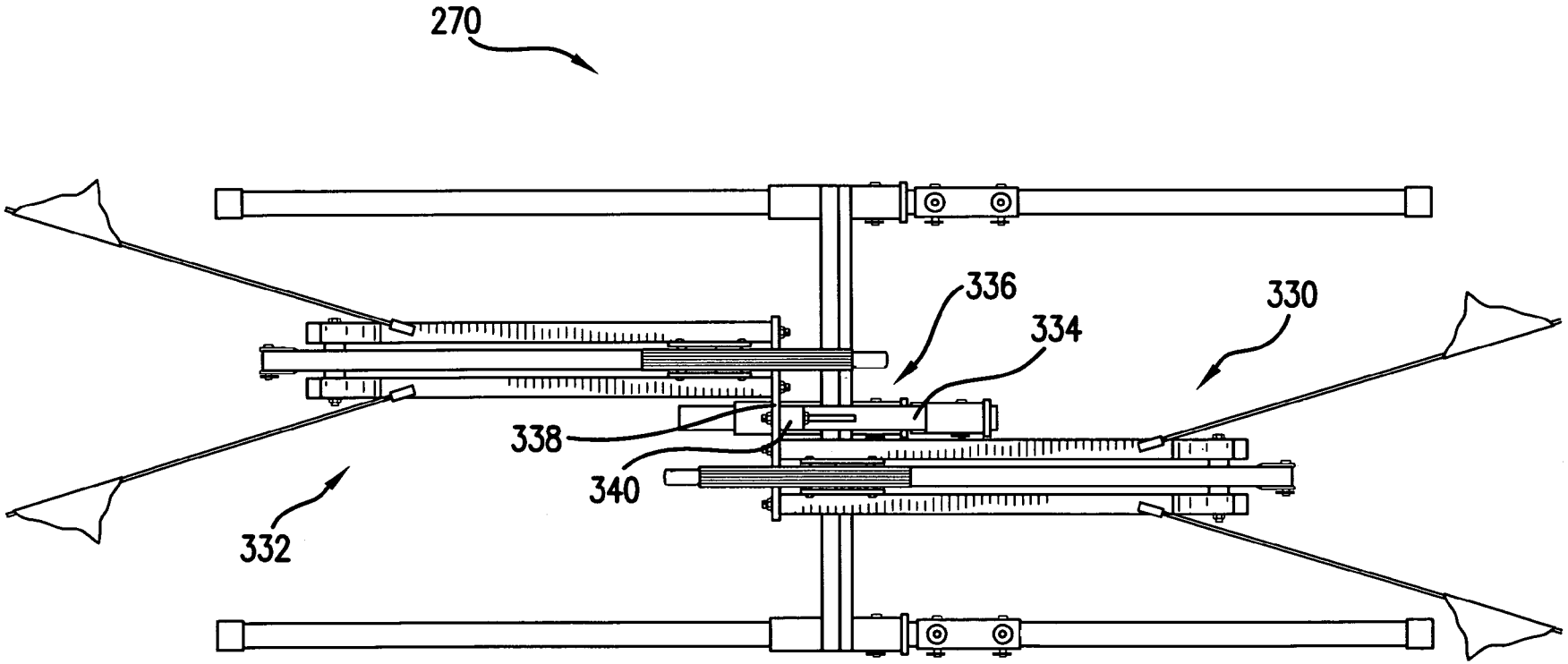
FIG. 15 is a top plan view of a complete assembly including the ground stand and vertical receiver extender, a right-angled mounting adapter, two mounting plates oriented horizontally, and two target launchers oriented in opposite directions.

By way of example, FIG. 15 is a top plan view of a double launcher ground stand mount configuration, where a pair of launchers 330 and 332 are oriented in opposite directions. In FIG. 15, the insert leg 334 of a right-angled mounting adapter 336 is received in the extender receiver 320, and a pair of mounting plates (only the upper mounting plate 338 is visible in FIG. 15) are secured to the vertical mounting adapter support leg 340. The two target launchers 330 and 332 are secured to the mounting plates 338 by attachment to the nominally vertical mounting legs 66 of the triangular frame members 62 and 64 of the target launchers 330 and 332.

As an alternative to the portable ground stand 270 described hereinabove with reference to FIGS. 13-15, a permanently mounted support post (not shown) including a receiver may be secured to a concrete base.

Up to this point, target launchers embodying the invention have been described in mounting configurations suitable for launching archery targets, where a cardboard archery target rotates on a horizontal axis. As is described next with reference to FIGS. 16-19, target launchers embodying the invention may also be mounted in a sideways offset configuration for launching "clay pigeons" for skeet shooting, where the targets rotate on an axis which is more nearly vertical.

Figure 16:
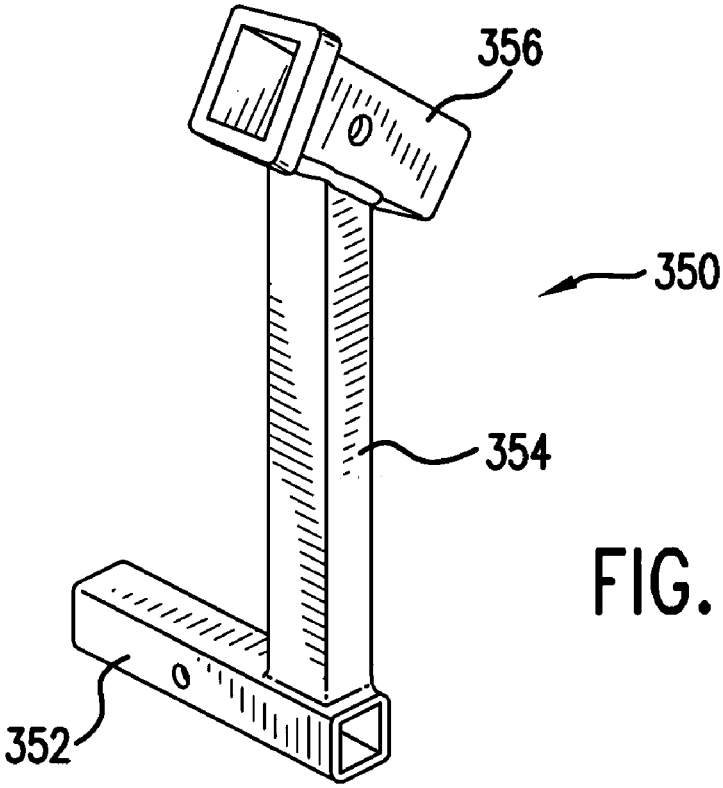
FIG. 16 is a three dimensional view showing a single-sleeve adapter tree with offset sleeve in isolation.
Figure 17:
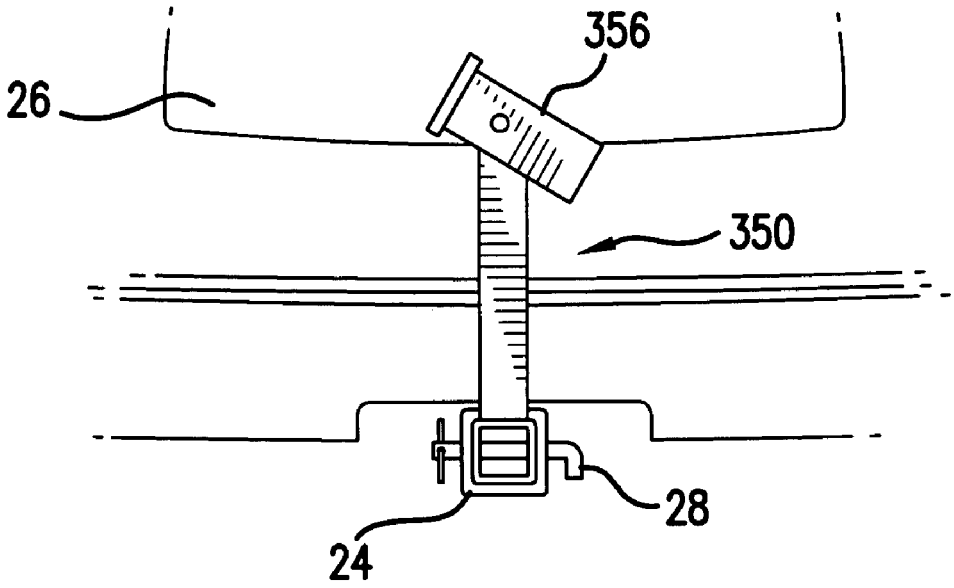
FIG. 17 is an end elevational view showing the single-sleeve adapter tree with offset sleeve mounted to mounted to the trailer hitch receiver attached to the rear of the vehicle.

FIG. 16 shows a single-sleeve offset adapter tree 350 in isolation, and FIG. 17 shows the single-sleeve offset adapter tree 350 mounted to the trailer hitch receiver 24 in turn attached to the rear of the vehicle 26. The single-sleeve adapter tree 350 includes a horizontal insert leg 352 which is received in the trailer hitch receiver 24, a vertical support 354, and an offset receiver 356 at the upper end of the vertical support.

Figure 18:
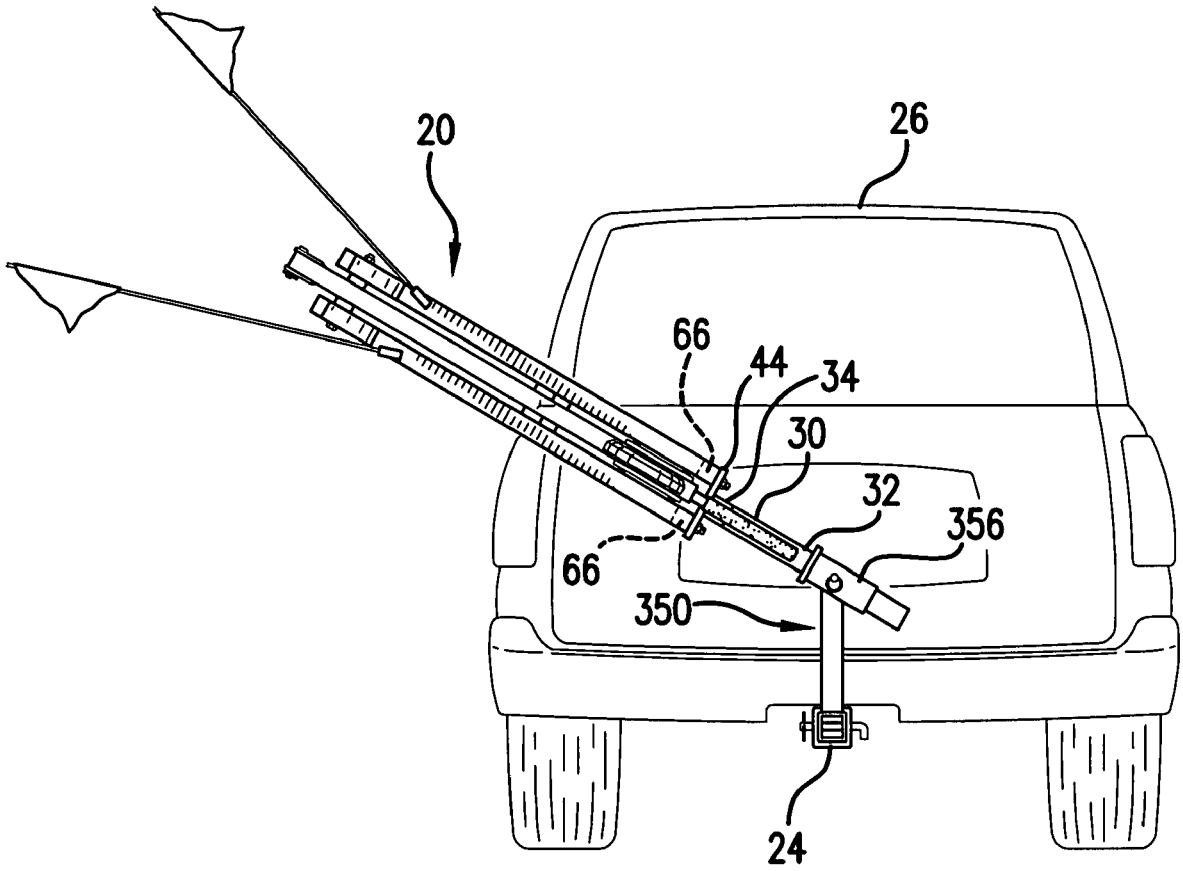
FIG. 18 is an end elevational view with a cocked target launcher in place in an offset position for throwing clay pigeons attached to the single-sleeve adapter tree with offset sleeve of FIG. 17, also employing a right-angled mounting adapter received in the sleeve of the adapter tree, and a mounting plate attached to the right-angled mounting adapter.

FIG. 18 depicts a single target launcher 20 attached via the single-sleeve adapter tree 350. In FIG. 18, a right-angled mounting adapter 30 (FIG. 4) is employed, with the mounting adapter insert leg 32 received in the offset receiver 356, and the mounting adapter support leg 34, which was nominally vertical in the configurations described hereinabove, extending horizontally, in a direction away from the vehicle 26. A mounting plate 44 is in turn secured to the mounting adapter support leg 34 and the mounting leg 66 of the target launcher 20 is secured to the mounting plate. Thus, compared to the configuration of FIGS. 1-3, in FIG. 18, the target launcher 20 is turned nearly on its side, and rotated ninety degrees so that what was the top of the target launcher in the orientation of FIGS. 1 and 2 is facing away from the rear of the vehicle in the FIG. 18 orientation.

Figure 19:
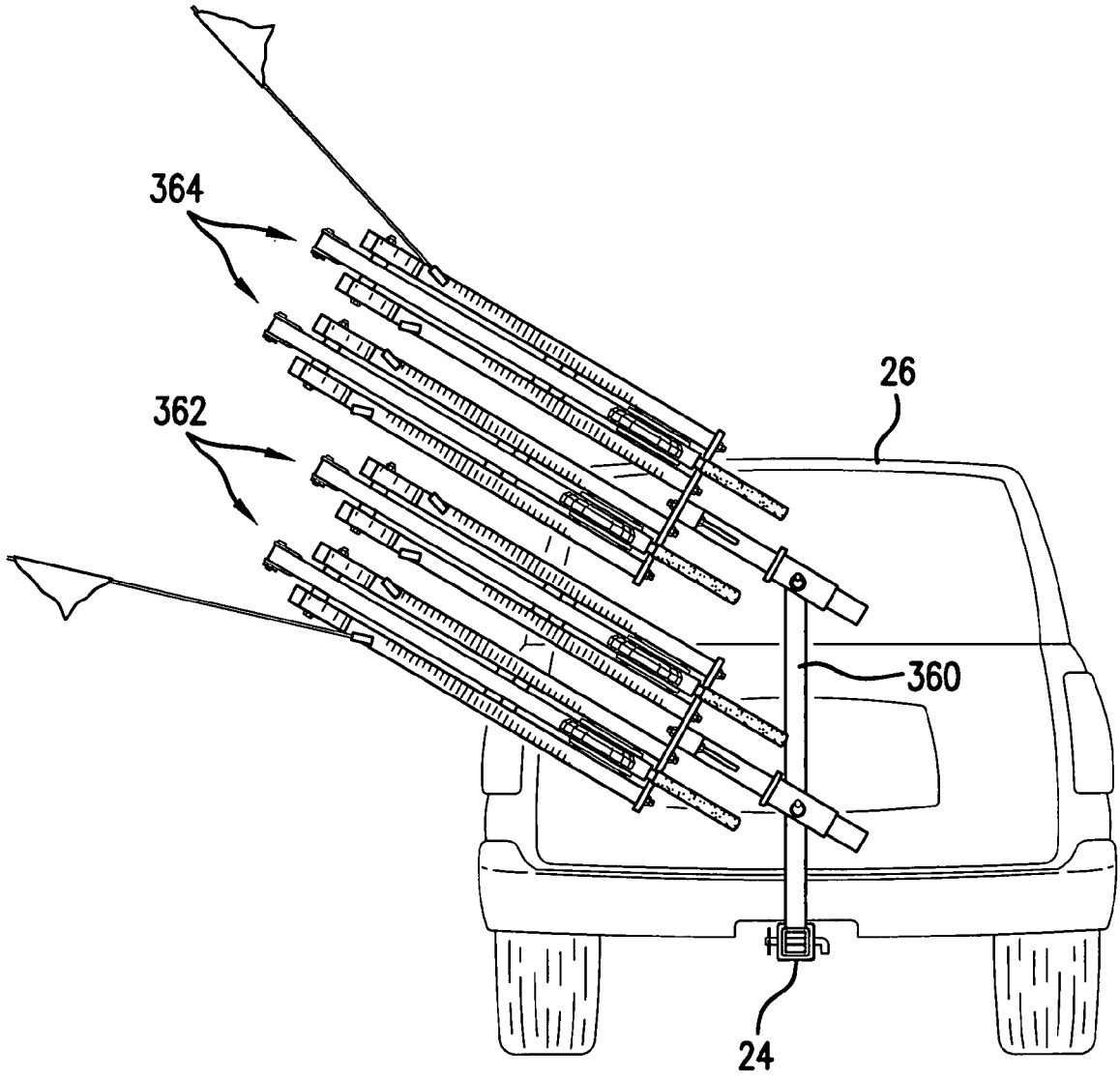
FIG. 19 is an end elevational view with four cocked target launchers in place (organized as two pairs) in the offset position for throwing clay pigeons attached to a double-sleeve adapter tree, also employing two right-angled mounting adapters received in the sleeves of the adapter tree, and four mounting plates (organized as two pairs) attached to the right-angled mounting adapters.

Referring finally to FIG. 19, a double offset launcher pair configuration is illustrated, employing a double-sleeve adapter tree 360 supporting four target launchers organized as two pairs 362 and 364. Each of the launcher pairs 362 and 364 in FIG. 19 is mounted to a respective sleeve of the dual-sleeve adapter tree 360 in the same manner as the pair of target launchers 220 and 222 in the vehicle-mount configuration of FIG. 10.

It will be appreciated that the various components embodying the invention as described herein may be assembled in a variety of configurations. By way of example, and not limitation, the following two tables, a "Vehicle Mount Configuration Table" and a "Ground Stand Configuration Table" summarize possible configurations, to be determined by user preference.

Vehicle Mount Configuration Table

| Mounting Configurations | Components Used |
|---|---|
| A. Single launcher (FIGS. 1, 2 & 3) | (Hitch receiver on vehicle)<br>1 right angle mounting adapter<br>1 mounting plate, oriented vertically<br>1 target launcher |
| B. Double launcher (FIG. 10) | (Hitch receiver on vehicle)<br>1 right angle mounting adapter<br>2 mounting plates, oriented horizontally<br>2 target launchers |
| C. ×3 Expansion bar (FIG. 12) | (Hitch receiver on vehicle)<br>1 receiver expansion bar<br>3 right angle mounting adapters<br>6 mounting plates, oriented horizontally<br>6 target launchers |
| D. Single offset launcher (FIG. 18) | (Hitch receiver on vehicle)<br>1 single-sleeve offset adapter tree<br>1 right angle mounting adapter<br>1 mounting plate<br>1 target launcher |
| E. Double offset launcher | (Hitch receiver on vehicle)<br>1 double-sleeve offset adapter tree<br>2 right angle mounting adapters<br>2 mounting plates<br>2 target launchers |
| F. Single offset launcher pair | (Hitch receiver on vehicle)<br>1 single-sleeve offset adapter tree<br>1 right angle mounting adapter<br>2 mounting plates<br>2 target launchers |
| G. Double offset launcher pair (FIG. 19) | (Hitch receiver on vehicle)<br>1 double-sleeve offset adapter tree<br>2 right angle mounting adapters<br>4 mounting plates<br>4 target launchers |

Ground Stand Configuration Table

| Mounting Configurations | Components Used |
|---|---|
| A. Single launcher | 1 receiver expansion bar<br>2 ground support extensions<br>1 vertical receiver extender<br>1 right angle mounting adapter<br>1 mounting plate, oriented vertically<br>1 target launcher |

-continued

Ground Stand Configuration Table

| Mounting Configurations | Components Used |
|---|---|
| B. Double launcher (opposite directions) (FIG. 15) | 1 receiver expansion bar<br>2 ground support extensions<br>1 vertical receiver extender<br>1 right angle mounting adapter<br>2 mounting plates, oriented horizontally<br>2 target launchers |
| C. Double launcher (same direction) | 1 receiver expansion bar<br>2 ground support extensions<br>1 vertical receiver extender<br>1 right angle mounting adapter<br>2 mounting plates, oriented horizontally<br>2 target launchers |
| D. Single offset launcher | 1 receiver expansion bar<br>2 ground support extensions<br>1 single-sleeve offset adapter tree<br>1 right angle mounting adapter<br>1 mounting plate<br>1 target launcher |
| E. Double offset launcher | 1 receiver expansion bar<br>2 ground support extensions<br>1 double-sleeve offset adapter tree<br>2 right angle mounting adapters<br>2 mounting plates<br>2 target launchers |
| F. Single offset launcher pair | 1 receiver expansion bar<br>2 ground support extensions<br>1 single-sleeve offset adapter tree<br>1 right angle mounting adapter<br>2 mounting plates<br>2 target launchers |
| G. Double offset launcher pair | 1 receiver expansion bar<br>2 ground support extensions<br>1 double-sleeve offset adapter tree<br>2 right angle mounting adapters<br>4 mounting plates<br>4 target launchers |

Accordingly, it will be appreciated that the invention may be embodied in a target launcher system set 370 capable of a plurality of configurations. The set 370 comprises a plurality of target launchers such as the target launchers 20, 220, and 222, each of the target launchers 20, 220, 222 including a pair of spaced-apart frame members 62, 64, each of the frame members 62, 62 in turn including a nominally vertical mounting leg 66 having an upper end 72 and a lower end 74, as well as a mounting side 68; a plurality of right-angled mounting adapters such as the right-angled mounting adapters 30, 256, 258 and 260, each of the right-angled mounting adapters 30, 256, 258, 260 having a mounting adapter insert leg 32 oriented horizontally and receivable in a trailer hitch receiver 24 attached to a vehicle 26, and a support leg 34 oriented vertically; a plurality of mounting plates such as the mounting plates 44, 262, 264, 266 for securing the vertical mounting legs 66 of the target launchers 20, 220, 222 to the support leg 34 of one of the right-angled mounting adapters 30, 256, 258, 260; a receiver expansion bar 230, 272 oriented horizontally and having an expansion bar insert leg 232 extending from the receiver expansion bar 230, 272 at a right-angled and oriented horizontally, the expansion bar insert leg 232 receivable in a trailer hitch receiver 24 attached to a vehicle 26, and the receiver expansion bar 230, 272 having a pair of end expansion receivers 234, 238, 274, 276 and an intermediate expansion receiver 236, 278 in the form of hollow square sleeves extending from the receiver expansion bar 230, 272 at right angles and oriented horizontally, the expansion receivers 234, 236, 238, 274, 276, 278 having openings facing generally in the opposite direction compared to the expansion bar insert leg 232; a pair of ground support extensions 280, 282 receivable in respective ones of the pair of end receivers 274, 276; and a vertical receiver extender 310 having an extender insert leg 314 oriented horizontally and receivable in the intermediate expansion receiver 278, an extension segment 316 extending upwardly from the extender insert leg 314 to an extension segment upper point 318, and an extender receiver 320 oriented horizontally and attached to the extension segment upper point 318. The set 370 is capable of a plurality of configurations. In particular, the set 370 is capable of a vehicle mount configuration with the mounting adapter insert leg 32 of one of the mounting adapters 30, 256, 258, 260 received in the trailer hitch receiver 24, and at least one of the target launchers 20, 220, 222 secured to the support leg 34 of the one of the mounting adapters 30, 256, 258, 260 via at least one of the mounting plates 44, 262, 264, 266. The set 370 is capable of an expanded vehicle mount configuration with the expansion bar insert leg 232 received in the trailer hitch receiver 24, the mounting adapter insert legs 32 of a plurality of the mounting adapters 30, 256, 258, 260 received in corresponding ones of the expansion receivers 234, 236, 238, and a plurality of target launchers 20, 220, 222 secured to corresponding support legs 34 of the plurality of mounting adapters 30, 256, 258, 260. The set 370 is capable of a ground stand 270 configuration with the pair of ground support extensions 280, 282 received in respective ones of the pair of end receivers 274, 276, the vertical receiver extender 310 insert leg 314 received in the intermediate expansion receiver 278, the mounting adapter insert leg 32 of one of the mounting adapters 30 received in the extender receiver 320, and at least one of the target launchers 20, 220, 222 secured to the support leg 34 of the one of the mounting adapters 30, 256, 258, 260 via at least one of the mounting plates 44, 262, 264, 266.

While particular embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A target launcher comprising:

a pair of spaced-apart triangular frame members, each of said frame members including a nominally vertical mounting leg having an upper end and a lower end, as well as a mounting side, a nominally horizontal upper leg joined to said upper end of said vertical mounting leg and extending in a direction away from said mounting side of said vertical mounting leg to a far end of said horizontal upper leg, a diagonal leg extending between and joined respectively to said far end of said horizontal upper leg and said lower end of said vertical mounting leg, and defining a junction of said diagonal leg with said horizontal upper leg;

a pivot element supported by said spaced-apart frame members in the general location of said junctions of said diagonal legs with said horizontal upper legs;

a target throwing arm supported between said triangular frame members, said target throwing arm having first and second ends, a pivot point intermediate said first and second ends connected to said pivot element, a target holder adjacent said first end, and an elastic device attachment at said second end, said target throwing arm pivoting about said pivot point between a cocked position and a throwing position;

an elastic device connected to said elastic device attachment for urging said target throwing arm from the cocked position to said throwing position;

a controllable latch for holding said target throwing arm in the cocked position and for releasing said target throwing arm when a target is to be launched; and a latch-engaging element attached to said target throwing arm near said first end thereof, said latch-engaging element including a substantially horizontal segment supported below said target throwing arm when said target throwing arm is in the cocked position;

said controllable latch in turn comprising:

a latch receiver including a pair of spaced-apart side plates each defining a "V" guide opening configured at the bottom to receive said horizontal segment, a pivot element below the bottom of the "V" guide openings, said pivot element defining a pivot axis perpendicular to and extending between said side plates, and a generally "C" shaped pivotable keeper located in between said side plates, said pivotable keeper having a lower pivot point cooperating with said pivot element, an upper segment-engaging surface, and an actuator arm extending perpendicularly to the pivot axis.

2. The target launcher of claim 1, wherein each of said triangular frame members further includes a pivot support extension extending generally upwardly from said junction of said diagonal leg with said horizontal upper leg, said pivot support extensions supporting said pivot element, whereby, in the cocked position, said target throwing arm is above and generally parallel to said horizontal upper legs.

3. The target launcher of claim 2, wherein, on each of said triangular frame members, said pivot support extension comprises a unitary extension of said diagonal leg.

4. A target launcher system comprising:

at least one target launcher including a pair of spaced-apart frame members, each of said frame members in turn including a nominally vertical mounting leg having an upper end and a lower end, as well as a mounting side;

at least one right-angled mounting adapter having a mounting adapter insert leg oriented horizontally and receivable in a trailer hitch receiver attached to a vehicle, and a support leg oriented vertically; and at least one mounting plate for securing said vertical mounting legs of said at least one target launcher to said support leg of said right-angled mounting adapter.

5. The target launcher system of claim 4, which comprises a single mounting plate in a vertical orientation for securing said vertical mounting legs of a single target launcher to said support leg.

6. The target launcher system of claim 5, which is in combination with a trailer hitch receiver attached to a vehicle, said mounting adapter insert leg being received in the trailer hitch receiver.

7. The target launcher system of claim 4, which comprises two mounting plates one above the other with each in a horizontal orientation for securing said vertical mounting legs of two target launchers to said vertical leg.

8. The target launcher system of claim 7, which is in combination with a trailer hitch receiver attached to a vehicle, said mounting adapter insert leg being received in the trailer hitch receiver.

9. The target launcher system of claim 4, which further comprises:

a receiver expansion bar oriented horizontally and having an expansion bar insert leg extending from said receiver expansion bar at a right angle and oriented horizontally, said expansion bar insert leg receivable in a trailer hitch receiver attached to a vehicle, and said receiver expansion bar having a plurality of expansion receivers in the form of hollow square sleeves extending from said receiver expansion bar at right angles and oriented horizontally, said expansion receivers having openings facing generally in the opposite direction compared to said expansion bar insert leg;

a plurality of right-angled mounting adapters, said mounting adapter insert legs being received in corresponding ones of said expansion receivers; and at least one target launcher secured to said support leg of at least one of said right-angled mounting adapters via at least one mounting plate.

10. The target launcher system of claim 9, which is in combination with a trailer hitch receiver attached to a vehicle, said mounting adapter insert leg being received in the trailer hitch receiver.

11. The target launcher system of claim 9, wherein:

said receiver expansion bar has three expansion receivers; and which comprises three right-angled mounting adapters; and six target launchers organized as three pairs, each pair of target launchers secured to said support leg of a corresponding one of said right-angled mounting adapters.

12. The target launcher system of claim 11, which is in combination with a trailer hitch receiver attached to a vehicle, said expansion bar insert leg being received in the trailer hitch receiver.

13. The target launcher system of claim 4, which further comprises a ground stand including a horizontal bar having a pair of end receivers and an intermediate receiver attached to and extending from said horizontal bar at right angles, and a pair of ground support extensions received in respective ones of said pair of end receivers; and a vertical receiver extender having an extender insert leg oriented horizontally and received in said intermediate receiver, an extension segment extending upwardly from said extender insert leg to an extension segment upper point, and an extender receiver oriented horizontally and attached to said extension segment upper point;

said mounting adapter insert leg of said right-angled mounting adapter being received in said extender receiver.

14. The target launcher system of claim 13, which comprises a pair of target launchers secured to said support leg of said right-angled mounting adapter.

15. The target launcher system of claim 14, wherein said target launchers face in opposite directions.

16. The target launcher system of claim 4, wherein said at least one target launcher in turn comprises:

a pair of spaced-apart triangular frame members, each of said frame members including a vertical mounting leg having an upper end and a lower end, as well as a mounting side, a horizontal upper leg joined to said upper end of said vertical mounting leg and extending in a direction away from said mounting side of said vertical mounting leg to a far end of said horizontal upper leg, a diagonal leg extending between and joined respectively to said far end of said horizontal upper leg and said lower end of said vertical mounting leg, and defining a junction of said diagonal leg with said horizontal upper leg;

a pivot element supported by said spaced-apart frame members in the general location of said junctions of said diagonal legs with said horizontal upper legs;

a target throwing arm supported between said triangular frame members, said target throwing arm having first and second ends, a pivot point intermediate said first and second ends connected to said pivot element, a target holder adjacent said first end, and an elastic device attachment at said second end, said target throwing arm pivoting about said pivot point between a cocked position and a throwing position;

an elastic device connected to said an elastic device attachment for urging said target throwing arm from the cocked position to said throwing position; and a controllable latch for holding said target throwing arm in the cocked position and for releasing said target throwing arm when a target is to be launched.

17. A target launcher system set capable of a plurality of configurations, said set comprising:

a plurality of target launchers, each of said target launchers including a pair of spaced-apart frame members, each of said frame members in turn including a nominally vertical mounting leg having an upper end and a lower end, as well as a mounting side;

a plurality of right-angled mounting adapters, each of said right-angled mounting adapters having a mounting adapter insert leg oriented horizontally and receivable in a trailer hitch receiver attached to a vehicle, and a support leg oriented vertically;

a plurality of mounting plates for securing said vertical mounting legs of said target launchers to said support legs of said right-angled mounting adapters;

a receiver expansion bar oriented horizontally and having an expansion bar insert leg extending from said receiver expansion bar at a right angle and oriented horizontally, said expansion bar insert leg receivable in a trailer hitch receiver attached to a vehicle, and said receiver expansion bar having a pair of end expansion receivers and an intermediate expansion receiver in the form of hollow square sleeves extending from said receiver expansion bar at right angles and oriented horizontally, said expansion receivers having openings facing generally in the opposite direction compared to said expansion bar insert leg;

a pair of ground support extensions receivable in respective ones of said pair of end receivers; and a vertical receiver extender having an extender insert leg oriented horizontally and receivable in said intermediate expansion receiver, an extension segment extending upwardly from said extender insert leg to an extension segment upper point, and an extender receiver oriented horizontally and attached to said extension segment upper point;

said set capable of a vehicle mount configuration with said mounting adapter insert leg of one of said mounting adapters received in the trailer hitch receiver, and at least one of said target launchers secured to said support leg of said one of said mounting adapters via at least one of said mounting plates;

said set capable of an expanded vehicle mount configuration with said expansion bar insert leg received in the trailer hitch receiver, said mounting adapter insert legs of a plurality of said mounting adapters received in corresponding ones of said expansion receivers, and a plurality of target launchers secured to corresponding support legs of said plurality of mounting adapters; and said set capable of a ground stand configuration with said pair of ground support extensions received in respective ones of said pair of end receivers, said extender insert leg received in said intermediate expansion receiver, said mounting adapter insert leg of one of said mounting adapters received in said extender receiver, and at least one of said target launchers secured to said support leg of said one of said mounting adapters via at least one of said mounting plates.

18. The set of claim 17, wherein each of said target launchers in turn comprises:

a pair of spaced-apart triangular frame members, each of said frame members including a vertical mounting leg having an upper end and a lower end, as well as a mounting side, a horizontal upper leg joined to said upper end of said vertical mounting leg and extending in a direction away from said mounting side of said vertical mounting leg to a far end of said horizontal upper leg, a diagonal leg extending between and joined respectively to said far end of said horizontal upper leg and said lower end of said vertical mounting leg, and defining a junction of said diagonal leg with said horizontal upper leg;

a pivot element supported by said spaced-apart frame members in the general location of said junctions of said diagonal legs with said horizontal upper legs;

a target throwing arm supported between said triangular frame members, said target throwing arm having first and second ends, a pivot point intermediate said first and second ends connected to said pivot element, a target holder adjacent said first end, and an elastic device attachment at said second end, said target throwing arm pivoting about said pivot point between a cocked position and a throwing position;

an elastic device connected to said an elastic device attachment for urging said target throwing arm from the cocked position to said throwing position; and a controllable latch for holding said target throwing arm in the cocked position and for releasing said target throwing arm when a target is to be launched.

* * * * *